US011001970B2

(12) United States Patent
Taniguchi et al.

(10) Patent No.: US 11,001,970 B2
(45) Date of Patent: May 11, 2021

(54) WEB FORMING DEVICE AND SHEET MANUFACTURING APPARATUS

(71) Applicant: Seiko Epson Corporation, Tokyo (JP)

(72) Inventors: Seiichi Taniguchi, Asahi (JP); Kaneo Yoda, Okaya (JP)

(73) Assignee: Seiko Epson Corporation

( * ) Notice: Subject to any disclaimer, the term of this patent is extended or adjusted under 35 U.S.C. 154(b) by 106 days.

(21) Appl. No.: 16/286,903

(22) Filed: Feb. 27, 2019

(65) Prior Publication Data

US 2019/0264393 A1 Aug. 29, 2019

(30) Foreign Application Priority Data

Feb. 28, 2018 (JP) ..... JP2018-035259
Jun. 7, 2018 (JP) ..... JP2018-109830

(51) Int. Cl.

| | |
|---|---|
| ***D21F 3/10*** | (2006.01) |
| ***D21F 11/00*** | (2006.01) |
| ***B65H 20/14*** | (2006.01) |
| ***D21F 3/02*** | (2006.01) |
| ***D04H 1/732*** | (2012.01) |
| ***D04H 1/60*** | (2006.01) |

(Continued)

(52) U.S. Cl.

CPC ..... *D21F 11/006* (2013.01); *B65H 20/14* (2013.01); *D04H 1/60* (2013.01); *D04H 1/732* (2013.01); *D21F 3/0272* (2013.01); *D21F 3/10* (2013.01); *D21F 9/00* (2013.01); *D21F 11/04* (2013.01)

(58) Field of Classification Search

USPC ..... 162/109, 261

See application file for complete search history.

(56) References Cited

U.S. PATENT DOCUMENTS

| | | | |
|---|---|---|---|
| 5,507,918 | A | 4/1996 | Polifke et al. |
| 2006/0008621 | A1 | 1/2006 | Gusky et al. |

(Continued)

FOREIGN PATENT DOCUMENTS

| | | | |
|---|---|---|---|
| JP | 05-186996 | | 7/1993 |
| JP | 2015-092032 | A | 5/2015 |
| JP | 2015-183321 | A | 10/2015 |

OTHER PUBLICATIONS

Extended European Search Report for Application No. EP 19 15 9780 dated Aug. 1, 2019 (7 pages).

*Primary Examiner* — Mark Halpern
(74) *Attorney, Agent, or Firm* — Harness, Dickey & Pierce, P.L.C.

(57) ABSTRACT

A web forming device includes: a first material supply unit provided with a first release port that releases a first material containing a first defibrated substance and a first organic binder in a gas atmosphere; a second material supply unit provided with a second release port that releases a second material in the gas atmosphere, the second material containing a second defibrated substance and a second organic binder and being different from the first material; and a transporting unit that forms and transports an accumulated substance obtained by accumulating the first material and the second material. The second release port is positioned downstream of the first release port in a transporting direction of the transporting unit, and the accumulated substance is a laminate obtained by laminating a layer of the first material and a layer of the second material.

9 Claims, 22 Drawing Sheets

(51) Int. Cl.
*D21F 9/00* (2006.01)
*D21F 11/04* (2006.01)

(56) References Cited

U.S. PATENT DOCUMENTS

2016/0230320 A1 8/2016 Ueno et al.
2019/0232606 A1* 8/2019 Ota ..... D21F 1/02

* cited by examiner

WEB FORMING DEVICE AND SHEET MANUFACTURING APPARATUS

CROSS REFERENCE TO RELATED APPLICATIONS

The present application is based on, and claims priority from Japanese Patent Application Serial Numbers 2018-035259, filed Feb. 28, 2018 and 2018-109830, filed Jun. 7, 2018, the disclosures of which are hereby incorporated by reference herein in their entirety.

BACKGROUND

1. Technical Field

The present disclosure relates to a web forming device and a sheet manufacturing apparatus.

2. Related Art

In recent years, as environmental awareness is raised, there are demands for not only a reduction in an amount of paper used in a workplace but also recycling of paper in a workplace or otherwise performing reusable printing "adapted to reuse" on paper. As an apparatus that recycles used paper, there is known an apparatus that defibrates the used paper so as to generate a defibrated substance and manufactures new paper from the defibrated substance (for example, see JP-A-5-186996).

The apparatus disclosed in JP-A-5-186996 includes a transporting unit that transports the defibrated substance, a supply unit that supplies the defibrated substance onto the transporting unit, and a pressurizing unit that pressurizes the supplied defibrated substance. In addition, a plurality of pairs of supply units and pressurizing units are provided at different positions with respect to a corresponding transporting unit, each supply/pressurizing pair forms a layer in which the defibrated substance is compressed, and recycled paper configured of a laminate of a plurality of layers is manufactured.

In addition, in the apparatus disclosed in JP-A-5-186996, a humidifying unit is provided for each supply/pressurizing pair. Therefore, when the defibrated substance is pressurized, the defibrated substance in a humidified state is pressurized. Accordingly, it is possible to increase the adhesiveness between the layers of defibrated substance.

In addition, as an apparatus that recycles used paper, there is known an apparatus that defibrates the used paper in a dry manner so as to generate a defibrated substance and manufactures new paper from the defibrated substance (for example, see JP-A-2015-92032). The apparatus disclosed in JP-A-2015-92032 is capable of mixing the defibrated substance, a resin for binding the defibrated substance, and a color material (coloring material) in a mixer, then, loosening the obtained mixture in a drum, and manufacturing paper having a color.

In addition, there is known an apparatus that includes a plurality of drums that loosen a mixture (for example, see U.S. Patent Application Publication No. 2006/0008621).

In addition, there is known an apparatus that is capable of obtaining a different percentage of color materials between a front side and a back side of the paper to be manufactured (for example, see JP-A-2015-183321).

However, in the apparatus disclosed in JP-A-5-186996, for example, in a case where color materials having different colors are mixed in each layer and a color of a sheet is changed, the color materials of the layers move easily between the layers because moisture infiltrates the entire laminate, and thus the color materials are likely to be mixed together. As a result, the colors of the layers are likely to be mixed, and thus it is difficult to obtain recycled paper having a desired color. In addition, there is a concern that, not only the color materials, but also additives contained in the layers and main raw materials of the layers will significantly infiltrate to the other layers.

In addition, in the apparatuses of all of JP-A-2015-92032, U.S. Patent Application Publication No. 2006/0008621, and JP-A-2015-183321, in a case where a color of a sheet is to be changed, for example, there is a concern that a color mixture that is not desired by a user will occur due to the color change. However, a reduction in color mixture that is not desired by the user is not disclosed in the related art. In addition, when a sheet having the color mixture that is not desired by the user is likely to be produced, a problem also arises in that the sheet to be manufactured by the apparatus is useless (wasted).

SUMMARY

An advantage of some aspects of the present disclosure is to provide a web forming device and a sheet manufacturing apparatus which are capable of imparting a desired function such as a color to each layer of a sheet to be obtained.

Hereinafter, means of the present disclosure and operation effects thereof will be described.

According to an aspect of the present disclosure, there is provided a web forming device including: a first material supply unit provided with a first release port that releases a first material containing a first defibrated substance and a first organic binder in a gas atmosphere; a second material supply unit provided with a second release port that releases a second material in the gas atmosphere, the second material containing a second defibrated substance and a second organic binder and being different from the first material; and a transporting unit that forms and transports an accumulated substance obtained by accumulating the first material and the second material. The second release port is positioned downstream of the first release port in a transporting direction of the transporting unit, and the accumulated substance is a laminate obtained by laminating a layer of the first material and a layer of the second material.

In the web forming device, the transporting unit may include a mesh belt configured to move in the transporting direction and a suction unit that suctions the layer of the first material and the layer of the second material which are accumulated on one surface side of the mesh belt, from another surface side of the mesh belt.

In the web forming device, the suction unit may include a first suction unit and a second suction unit provided downstream of the first suction unit in the transporting direction of the transporting unit.

In the web forming device, the first material supply unit may include a first drum section provided with a hole through which the first material passes and a first housing section that houses the first drum section and is provided with the first release port, and the second material supply unit may include a second drum section provided with a hole through which the second material passes and a second housing section that houses the second drum section and is provided with the second release port.

The web forming device may further include at least one of a first functional material supply unit that supplies a first functional material to the first material supply unit and a second functional material supply unit that supplies a second functional material to the second material supply unit.

In the web forming device, both the first functional material supply unit and the second functional material supply unit may be provided, and the first functional material and the second functional material may be materials having colors different from each other.

The web forming device may further include a supply-amount adjusting unit that adjusts at least one of a supply amount of the first material and a supply amount of the second material.

The web forming device may further include a third material supply unit provided with a third release port that releases a third material in the gas atmosphere, the third material containing a third defibrated substance and a third organic binder and being different from the second material, in which the third release port may be positioned downstream of the second release port in the transporting direction.

The web forming device may further include: a first defibration unit that defibrates used paper to generate the first defibrated substance; and a second defibration unit that defibrates used paper to generate the second defibrated substance.

In the web forming device, the drum may include a discharge portion that discharges the material, and a plurality of drums may be provided for the respective color materials having colors different from each other, which are supplied from the color material supply units, and the mixer may house the plurality of drums from which the color materials and the materials are discharged, individually, and mix the color materials having colors different from each other.

According to another aspect of the present disclosure, there is provided a sheet manufacturing apparatus including: the web forming device described above; and a forming unit that heats and pressurizes the laminate to form the laminate into a sheet shape.

DESCRIPTION OF EXEMPLARY EMBODIMENTS

Hereinafter, a web forming device and a sheet manufacturing apparatus of the present disclosure will be described in detail on the basis of exemplary embodiments illustrated in the accompanying drawings.

In the following embodiments, for convenience of description, in schematic side views and vertical sectional views, an upper side means "on" or "above", and a lower side means "under" or "below". In addition, for convenience of description, three axes orthogonal to each other are illustrated as an x axis, a y axis, and a z axis, in some cases. Of the three axes, an xy-plane containing the x axis and the y axis is horizontal, and the z axis is perpendicular thereto. In addition, a direction to which an arrow of each direction points is referred to as "positive", and a reverse direction thereof is referred to as "negative".

First Embodiment

Figure 1:
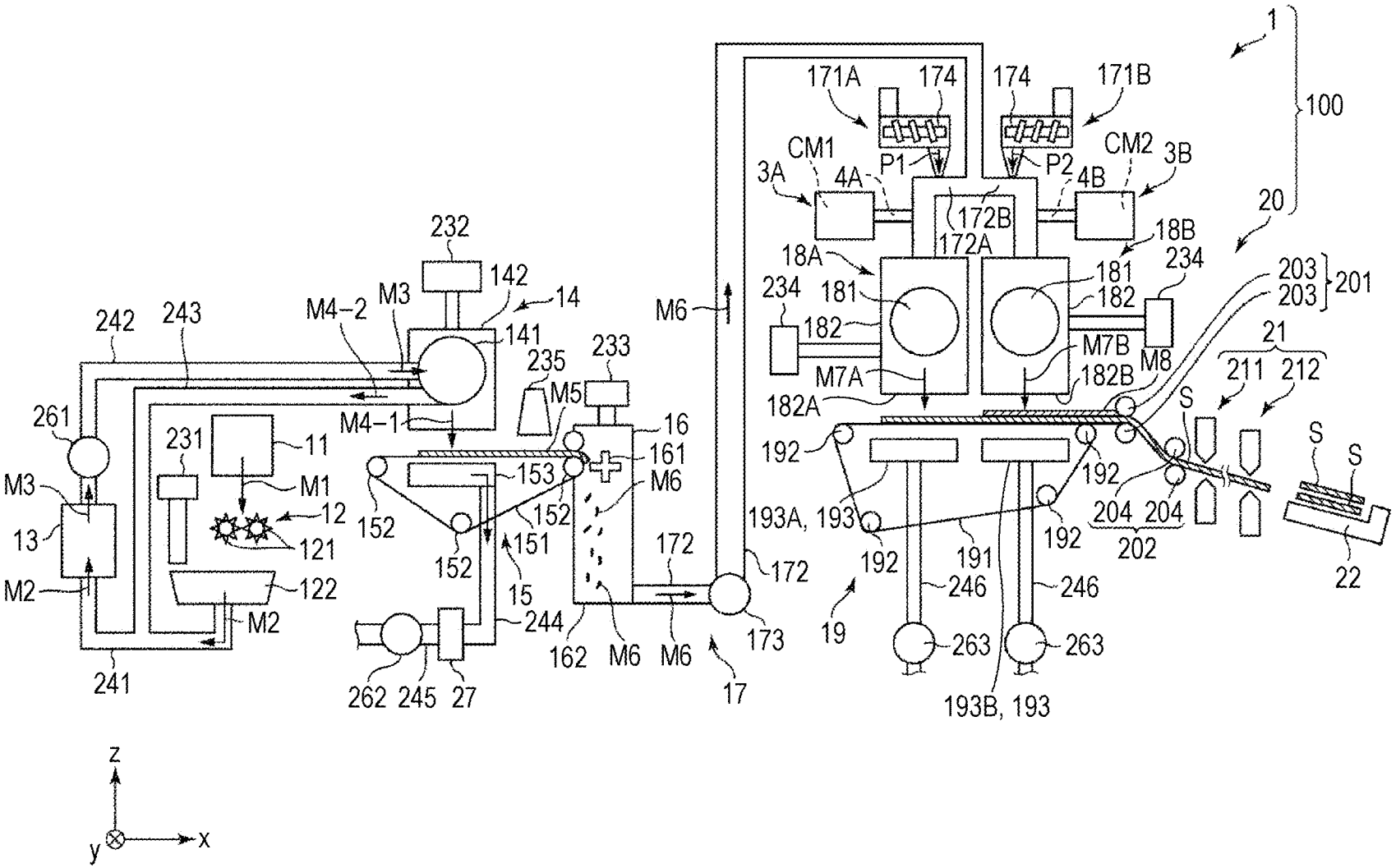
FIG. 1 is a schematic side view illustrating a sheet manufacturing apparatus of a first embodiment to which the present disclosure is applied.
Figure 2:
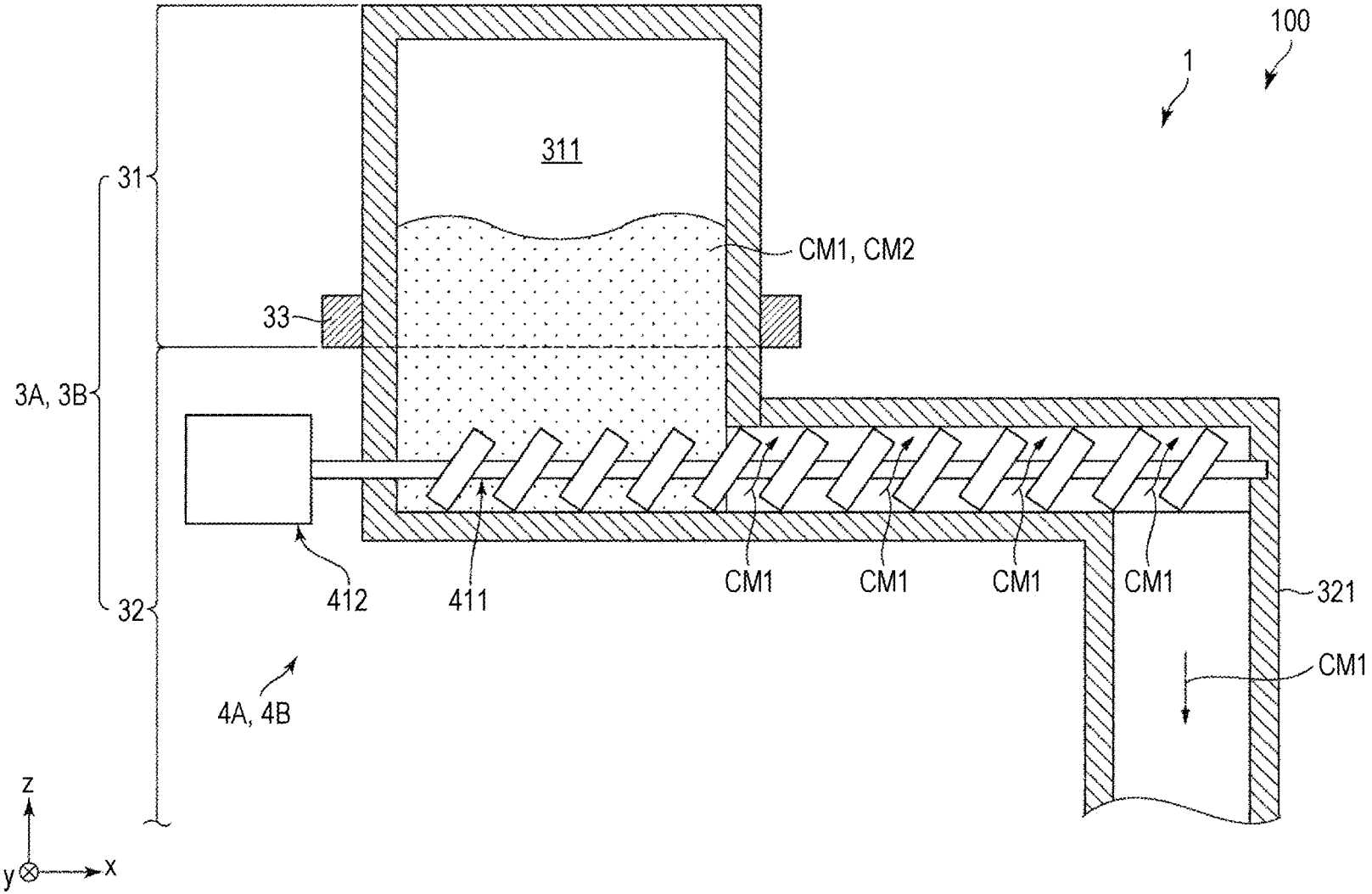
FIG. 2 is a vertical sectional view illustrating a first functional material supply unit (second functional material supply unit) and a periphery thereof included in the sheet manufacturing apparatus illustrated in FIG. 1.
Figure 3:
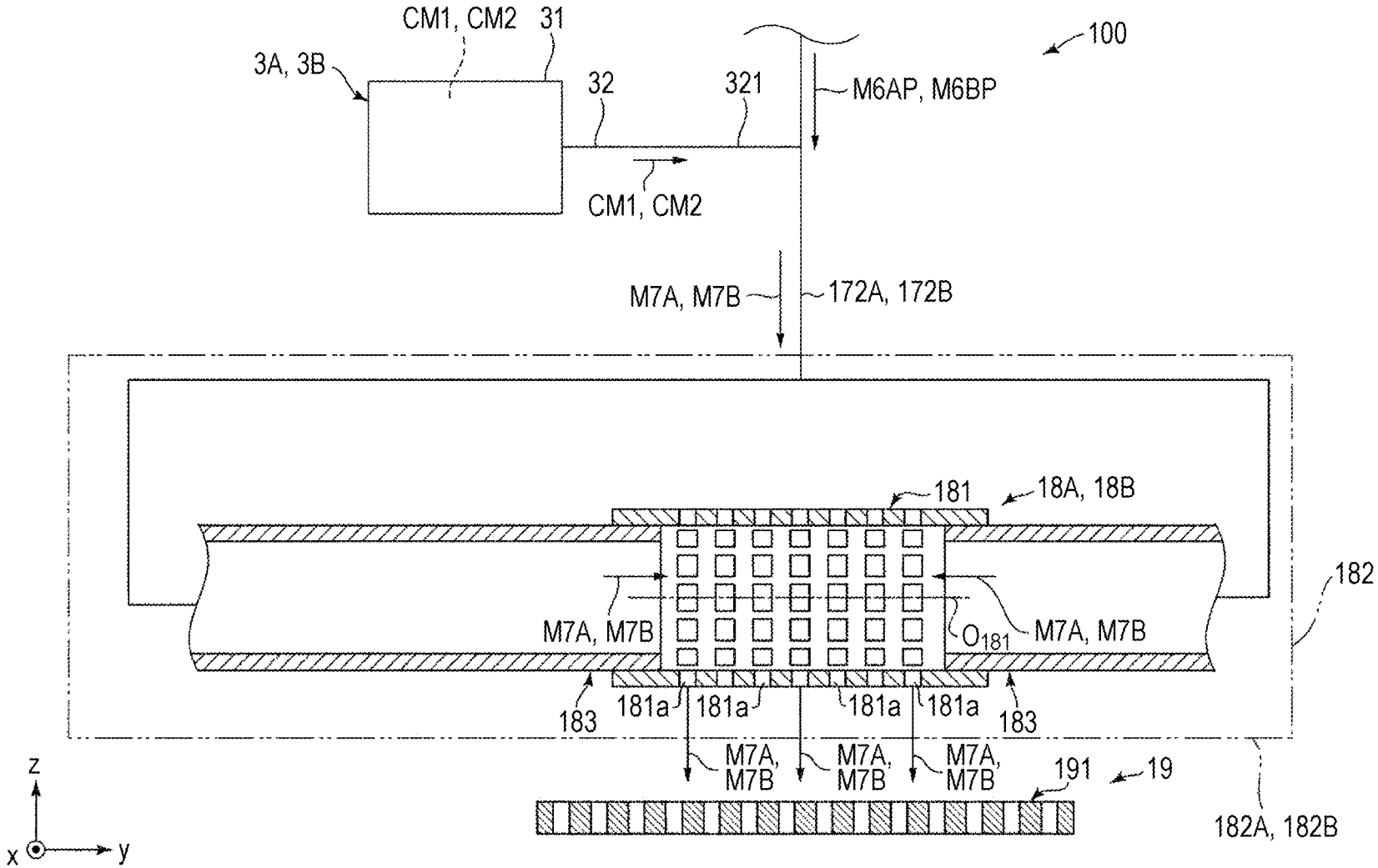
FIG. 3 is a schematic configurational view (partial vertical sectional view) illustrating a first material supply unit, a second material supply unit, and a periphery thereof included in the sheet manufacturing apparatus illustrated in FIG. 1.
Figure 4:
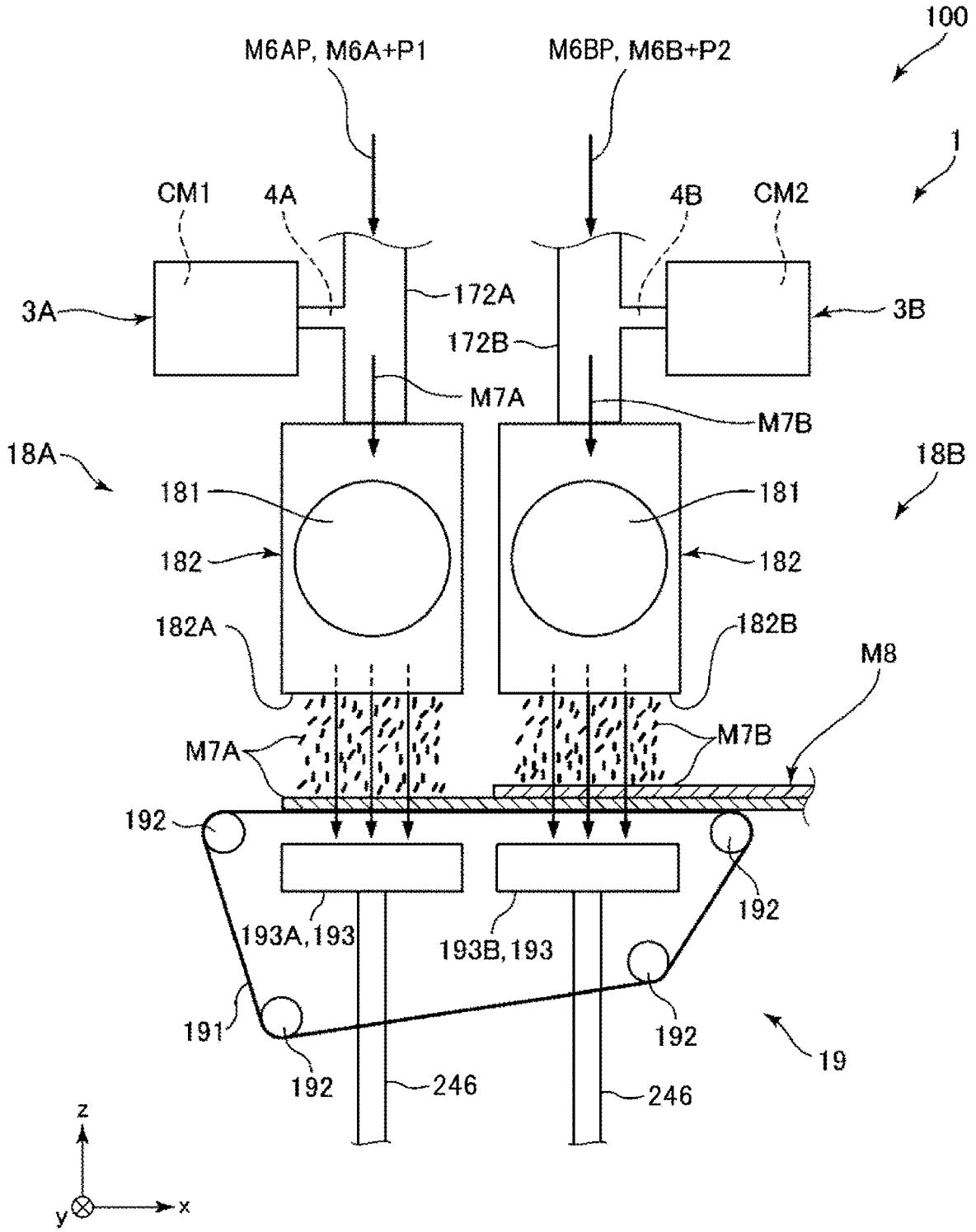
FIG. 4 is a schematic configurational view (partial vertical sectional view) illustrating the first material supply unit (second material supply unit) and a periphery thereof included in the sheet manufacturing apparatus illustrated in FIG. 1.
Figure 5:
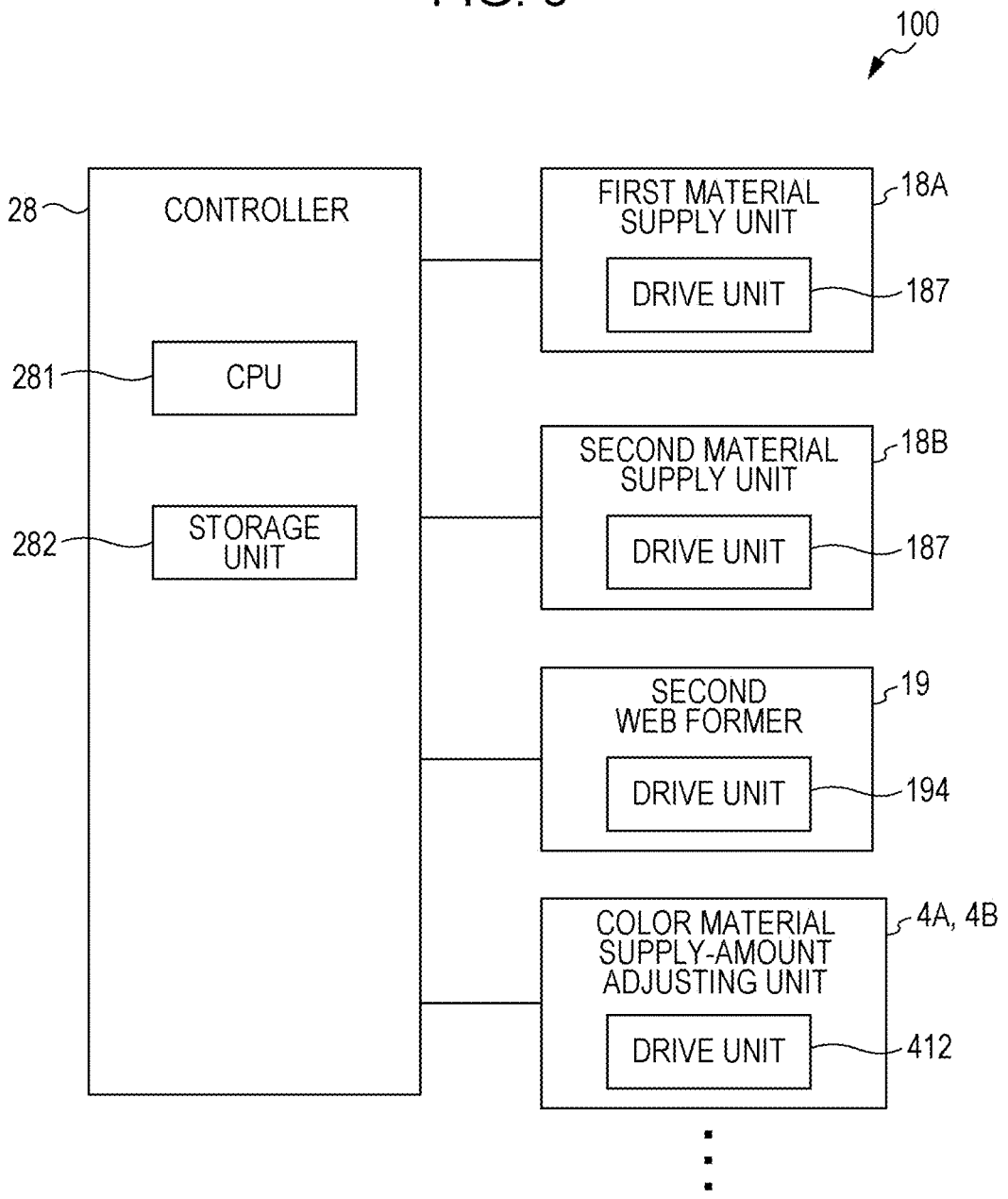
FIG. 5 is a block diagram of main components included in the sheet manufacturing apparatus illustrated in FIG. 1.

FIG. 1 is a schematic side view illustrating a first embodiment in a case where the web forming device of the present disclosure is applied to the sheet manufacturing apparatus. FIG. 2 is a vertical sectional view illustrating a first functional material supply unit (second functional material supply unit) and a periphery thereof included in the sheet manufacturing apparatus illustrated in FIG. 1. FIG. 3 is a schematic configurational view (partial vertical sectional view) illustrating a first material supply unit (second material supply unit) and a periphery thereof included in the sheet manufacturing apparatus illustrated in FIG. 1. FIG. 4 is a schematic configurational view (partial vertical sectional view) illustrating the first material supply unit (second material supply unit) and a periphery thereof included in the sheet manufacturing apparatus illustrated in FIG. 1. FIG. 5 is a block diagram of main components included in the sheet manufacturing apparatus illustrated in FIG. 1.

As illustrated in FIG. 1, a sheet manufacturing apparatus 100 is an apparatus that manufactures a sheet S and includes a raw material supply unit 11, a rough crushing unit 12, a defibration unit 13, a sorting unit 14, a first web former 15, a subdivision unit 16, a mixer 17, a first material supply unit 18A, a second material supply unit 18B, a second web former 19, a forming unit 20, a cutter 21, a stock unit 22, a collection unit 27, a color material supply unit 3A as a first functional material supply unit, a color material supply unit 3B as a second functional material supply unit, a color material supply-amount adjusting unit 4A, and a color material supply-amount adjusting unit 4B. Of the units, the web forming device 1 is configured of units upstream of the forming unit 20.

In addition, the sheet manufacturing apparatus 100 includes a humidifying unit 231, a humidifying unit 232, a humidifying unit 233, a humidifying unit 234, and a humidifying unit 235. Additionally, the sheet manufacturing apparatus 100 includes a blower 261, a blower 262, and a blower 263.

In addition, as illustrated in FIG. 5, the units included in the sheet manufacturing apparatus 100 are electrically coupled to a controller 28. In this manner, operations of the units are controlled by the controller 28. The controller 28 includes a central processing unit (CPU) 281 and a storage unit 282 (memory). For example, the CPU 281 is capable of performing various types of determination, issuing various types of instructions, or the like. For example, the storage unit 282 stores various types of programs such as programs used until the sheet S is manufactured. In addition, the controller 28 may be installed in the sheet manufacturing apparatus 100 or may be provided in an external device such as a computer on the outside. In addition, the external device may communicate with the sheet manufacturing apparatus 100 via a cable, may communicate therewith wirelessly, or may be connected to the sheet manufacturing apparatus 100 via a network (for example, Internet), for example. In addition, the CPU 281 and the storage unit 282 may be integrally configured as one unit, for example. The CPU 281 may be installed in the sheet manufacturing apparatus 100, and the storage unit 282 may be provided in an external device such as a computer on the outside. Otherwise, the storage unit 282 may be installed in the sheet manufacturing apparatus 100, and the CPU 281 may be provided in an external device such as a computer on the outside.

In addition, in the sheet manufacturing apparatus 100, a raw material supplying step, a rough crushing step, a defibrating step, a sorting step, a first web forming step, a dividing step, a mixing step, a loosening step, a second web forming step, a sheet forming step, and a cutting step are executed in this order. In addition, in the sheet manufacturing apparatus 100, it is also possible to execute a color material supplying step.

Hereinafter configurations of the units will be described.

The raw material supply unit 11 executes the raw material supplying step of supplying a raw material M1 to the rough crushing unit 12. The raw material M1 is a sheet-shaped material containing a fiber. The fiber may be a natural fiber (animal fiber or plant fiber) or a synthetic fiber. However, it is preferable that the fiber be the natural fiber. The natural fiber (animal fiber or plant fiber) includes a fiber made of cellulose, silk, wool, cotton, cannabis, kenaf, flax, ramie, jute, Manila hemp, sisal hemp, a coniferous tree, a broad-leaved tree, or the like. The fibers may be used individually, may be appropriately mixed to be used, or may be used as a recycled fiber through purification or the like. In addition, the fiber may be dried or may contain or be impregnated with a liquid such as water or an organic solvent.

Of the materials described above, it is preferable to use cellulose. Cellulose obtained by containing, as a main component, cellulose (cellulose in a narrow definition) as a compound, which has a fiber shape, may be used, or cellulose containing hemicellulose or lignin other than cellulose (cellulose in a narrow definition) may be used.

In addition, a type of raw material M1 is not limited and may be a woven fabric or a nonwoven fabric. In addition, the raw material M1 may be recycled paper that is manufactured (recycled) by defibrating used paper or Yupo paper (registered trademark) of synthetic paper, for example.

The rough crushing unit 12 executes the rough crushing step of roughly crushing the raw material M1 supplied from the raw material supply unit 11 in a gas atmosphere such as in the atmosphere (in the air). The rough crushing unit 12 includes a pair of rough crushing blades 121 and a chute (hopper) 122.

The pair of rough crushing blades 121 rotates in reverse directions from each other, thereby, being capable of roughly crushing, that is, cutting the raw material M1 therebetween so as to obtain rough-crushed pieces M2. It is preferable that a shape or a size of the rough-crushed pieces M2 be suitable for a defibrating process in the defibration unit 13. For example, the rough-crushed piece is preferably a small piece of which a length of one side is 100 mm or smaller and, more preferably, a small piece of which a length of one side is 10 mm or larger and 70 mm or smaller.

The chute 122 is disposed below the pair of rough crushing blades 121 and has a funnel shape, for example. Consequently, the chute 122 is capable of receiving the rough-crushed pieces M2 which are roughly crushed by the rough crushing blades 121 and fall down.

In addition, the humidifying unit 231 is disposed to be adjacent to the pair of rough crushing blades 121 below the chute 122. The humidifying unit 231 humidifies the rough-crushed pieces M2 in the chute 122. The humidifying unit 231 is configured of a vaporization-type humidifier (also known as a vaporizer) that has a filter (not illustrated) containing water and causes the air to pass through the filter, thereby, supplying humidified air having high humidity to the rough-crushed pieces M2. The humidified air is supplied to the rough-crushed pieces M2, and thereby it is possible to suppress attachment of the rough-crushed pieces M2 to the chute 122 or the like due to static electricity.

The chute 122 is coupled to the defibration unit 13 via a pipe (flow channel) 241. The rough-crushed pieces M2 gathered in the chute 122 pass through the pipe 241 so as to be transported to the defibration unit 13.

The defibration unit 13 executes the defibrating step of defibrating the rough-crushed pieces M2 in the gas atmosphere, that is, in a dry manner. It is possible to generate a defibrated substance M3 from the rough-crushed pieces M2 through the defibrating process in the defibration unit 13. Here, "to defibrate" means to unravel fibers one by one from the rough-crushed pieces M2 in which a plurality of fibers are bound. In this manner, an unraveled substance is the defibrated substance M3. A shape of the defibrated substance M3 is a line shape or a strip shape. In addition, the defibrated substances M3 may be present in a state of intertwining and clumping, that is, a state of forming a so-called "ball".

For example, in the embodiment, the defibration unit 13 is configured of an impeller mill that includes a rotor that rotates at a high speed and a liner that is positioned along an outer circumference of the rotor. The rough-crushed pieces M2 that have flowed into the defibration unit 13 are sandwiched between the rotor and the liner so as to be defibrated.

In addition, the defibration unit 13 is capable of generating a current of the air (air current) from the rough crushing unit 12 toward the sorting unit 14 due to rotation of the rotor. Consequently, it is possible to suction the rough-crushed pieces M2 to the defibration unit 13 from the pipe 241. In addition, after the defibrating process, the defibrated substance M3 can be delivered to the sorting unit 14 via a pipe (flow channel) 242.

The blower 261 is installed at a position on the pipe 242. The blower 261 is an air current generating device that generates an air current toward the sorting unit 14. Consequently, delivery of the defibrated substance M3 to the sorting unit 14 is promoted.

The sorting unit 14 executes a sorting step of sorting the defibrated substances M3 into fibers having short and long lengths. In the sorting unit 14, the defibrated substances M3 are sorted into a first sorted substance M4-1 and a second sorted substance M4-2 that is larger than the first sorted substance M4-1. The first sorted substance M4-1 has a size suitable for manufacturing the sheet S in the subsequent stage. An average length thereof is preferably 100 μm or larger and 10 mm or smaller. On the other hand, the second sorted substance M4-2 includes a substance which is not sufficiently defibrated or an immoderate clump of defibrated fibers.

The sorting unit 14 has a drum section 141 and a housing section 142 that houses the drum section 141.

The drum section 141 is a sieve that is configured of a net body having a circular cylinder shape and rotates around a center axis of the drum section. The defibrated substance M3 flows into the drum section 141. In this manner, the drum section 141 rotates, and thereby the defibrated substance M3 is sorted as the first sorted substance M4-1, and the defibrated substance M3 having a size equal to or larger than a mesh opening of the net is sorted as the second sorted substance M4-2. A shape of the drum section 141 is not limited to the circular cylinder shape, and may have a polygonal cylinder shape such as a triangular, quadrangular, hexagonal, or octagonal cylinder shape, for example.

The first sorted substance M4-1 falls down from the drum section 141.

On the other hand, the second sorted substance M4-2 is delivered to a pipe (flow channel) 243 that is coupled to the drum section 141. An end portion of the pipe 243 on an opposite side (downstream) of an end portion thereof that is coupled to the drum section 141 is coupled to the pipe 241. The second sorted substance M4-2 that has passes through the pipe 243 is joined to the rough-crushed pieces M2 in the pipe 241 so as to flow together with the rough-crushed pieces M2 into the defibration unit 13. Consequently, the second sorted substance M4-2 is caused to return to the defibration unit 13 so as to be subjected to the defibrating process together with the rough-crushed pieces M2.

In addition, the first sorted substances M4-1 that have fallen down from the drum section 141 fall down while being dispersed in the gas atmosphere toward the first web former 15 as a separation unit that is positioned below the drum section 141. The first web former 15 executes the first web forming step of forming a first web M5 from the first sorted substance M4-1. The first web former 15 includes a mesh belt 151 as a separation belt, three stretching rollers 152, and a suction unit 153 as a suction mechanism.

The mesh belt 151 is an endless belt (conveyer belt) and accumulates the first sorted substances M4-1. The mesh belt 151 loops around the three stretching rollers 152. In this manner, the stretching rollers 152 are rotatably driven, and thereby the first sorted substance M4-1 on the mesh belt 151 is transported as the first web M5 downstream.

The first sorted substance M4-1 has a size equal to or larger than a mesh opening of the mesh belt 151. Consequently, the first sorted substance M4-1 is restricted from passing through the mesh belt 151, and thereby it is possible to accumulate the first sorted substance M4-1 on the mesh belt 151. In addition, the first sorted substances M4-1 are transported along with the mesh belt 151 downstream while being accumulated on the mesh belt 151 and, thus, are formed into the layer-shaped first web M5.

In addition, there is a concern that dirt, dust, or the like will be mixed with the first sorted substance M4-1. For example, the dirt or the dust may be produced through the rough crushing or defibration. In this manner, the dirt or the dust is collected in the collection unit 27 to be described below.

The suction unit 153 is capable of suctioning air from below the mesh belt 151 with respect to an accumulation surface of the first sorted substance M4-1. Consequently, it is possible to suction the dirt or the dust, which has passed through the mesh belt 151, along with the air.

In addition, the suction unit 153 is coupled to the collection unit 27 via a pipe (flow channel) 244. The dirt or the dust suctioned by the suction unit 153 is collected in the collection unit 27.

A pipe (flow channel) 245 is further coupled to the collection unit 27. In addition, the blower 262 is installed at a position on the pipe 245. An operation of the blower 262 can generate a suction force by the suction unit 153. Consequently, the first sorted substance M4-1 is suctioned from below, and thereby forming of the first web M5 on the mesh belt 151 is promoted. The first web M5 is a web from which the dirt, the dust, or the like is removed. In addition, the operation of the blower 262 causes the dirt or the dust to pass through the pipe 244 and reach the collection unit 27.

The housing section 142 is coupled to the humidifying unit 232. The humidifying unit 232 is configured of the same vaporization-type humidifier as the humidifying unit 231. Consequently, the humidified air is supplied into the housing section 142. It is possible to humidify the first sorted substance M4-1 with the humidified air, and thereby it is possible to suppress attachment of the first sorted substance M4-1 to an inner wall of the housing section 142 due to an electrostatic force.

The humidifying unit 235 is disposed downstream of the sorting unit 14. The humidifying unit 235 is configured of an ultrasound-type humidifier that sprays water. Consequently, it is possible to supply moisture to the first web M5, and thereby a moisture amount of the first web M5 is adjusted. Adjustment of the moisture amount makes it possible to suppress attachment of the first web M5 to the mesh belt 151 due to the electrostatic force. Consequently, the first web M5 is easily peeled from the mesh belt 151 at a position at which the mesh belt 151 is bent by the stretching roller 152.

For example, a moisture amount (total moisture amount) from the humidifying unit 231 to the humidifying unit 235 is preferably 0.5 parts by mass or larger and 20 parts by mass or smaller in terms of 100 parts by mass of a material before humidifying.

The subdivision unit 16 is disposed downstream of the humidifying unit 235. The subdivision unit 16 executes the dividing step of dividing the first web M5 peeled from the mesh belt 151. The subdivision unit 16 includes a propeller 161 that is rotatably supported and a housing section 162 that houses the propeller 161. In this manner, the rotating propeller 161 can divide the first web M5. The divided first webs M5 are subdivided bodies M6. In addition, the subdivided bodies M6 drops down in the housing section 162.

The housing section 162 is coupled to the humidifying unit 233. The humidifying unit 233 is configured of the same vaporization-type humidifier as the humidifying unit 231. Consequently, the humidified air is supplied into the housing section 162. The humidified air makes it possible to suppress attachment of the subdivided bodies M6 to an inner wall of the propeller 161 or the housing section 162 due to an electrostatic force.

The mixer 17 is disposed downstream of the subdivision unit 16. The mixer 17 executes the mixing step of mixing the subdivided bodies M6 and a binder P1 or a binder P2 to be described below. The mixer 17 includes a binder supply unit 171A, a binder supply unit 171B, a pipe 172, and a blower 173.

The pipe 172 is a flow channel which couples the subdivision unit 16, the first material supply unit 18A, and the second material supply unit 18B to each other and through which the subdivided bodies M6 pass. In addition, the blower 173 is installed at a position on the pipe 172. An operation of a rotation unit such as a vane provided in the blower 173 makes it possible to generate an air current toward the first material supply unit 18A and the second material supply unit 18B.

In addition, the pipe 172 diverges to a pipe 172A and a pipe 172B at a position of the pipe 172. The pipe 172A is coupled to the first material supply unit 18A, and the pipe 172B is coupled to the second material supply unit 18B. In the embodiment, the subdivided bodies M6 that flow down through the pipe 172 are distributed to the pipe 172A and the pipe 172B by substantially the same amount as each other. The subdivided bodies M6 that flow down through the pipe 172A correspond to first defibrated substances referred to as subdivided bodies M6A. In addition, the subdivided bodies M6 that flow down through the pipe 172B correspond to second defibrated substances referred to as subdivided bodies M6B (refer to FIG. 4).

In addition, the binder supply unit 171A that supplies the binder P1 as a first organic binder is provided in the pipe 172A, and the binder supply unit 171B that supplies the binder P2 as a second organic binder is provided in the pipe 172B. In the embodiment, since the binder supply unit 171A and the binder supply unit 171B have the same configuration, hereinafter, the binder supply unit 171A will be representatively described.

The binder supply unit 171A includes a screw feeder 174. The screw feeder 174 is rotatably driven, and thereby it is possible to supply the binder P1 as powder or particles to the pipe 172A. The binder P1 supplied to the pipe 172A is mixed with the subdivided bodies M6A such that a mixture M6AP is obtained. In addition, the binder P2 supplied to the pipe 172B is mixed with the subdivided bodies M6B such that a mixture M6BP is obtained.

In the embodiment, since the binder P1 and the binder P2 have the same configuration, hereinafter, the binder P1 will be representatively described.

As the binder P1, it is possible to use an organic binder such as thermoplastic resin or thermosetting resin, and examples thereof include AS resin, ABS resin, polypropylene, polyethylene, polyvinyl chloride, polystyrene, acrylic resin, polyester resin, polyethylene terephthalate, polyphenylene ether, polybutylene terephthalate, nylon, polyamide, polycarbonate, polyacetal, polyphenylene sulfide, or polyether ether ketone. In addition, the resins described above may be used individually or in a proper combination thereof.

In addition, as the binder P1, any of natural resin and synthetic resin may be used, or any of thermoplastic resin and thermosetting resin may be used as a type of resin that is a component of resin powder (component of resin particles). In the sheet manufacturing apparatus 100 of the embodiment, resin that configures the resin powder is preferably a solid at room temperature, and it is more preferable to use thermoplastic resin with consideration for binding the fibers with heat in the forming unit 20 and recycling of a sheet to be manufactured.

Examples of natural resin include rosin, dammar, mastics, copal, amber, shellac, stonecrop serum, sandarac, or colophony. The resins may be used individually or an appropriate combination thereof, or properties thereof may be appropriately changed.

An example of thermosetting resin of the synthetic resins includes thermosetting resin such as phenol resin, epoxy resin, melamine resin, urea resin, unsaturated polyester resin, alkyd resin, polyurethane, or thermosetting polyimide resin.

In addition, examples of thermoplastic resin of the synthetic resins include AS resin, ABS resin, polypropylene, polyethylene, polyvinyl chloride, polystyrene, acrylic resin, polyester resin, polyethylene terephthalate, polyphenylene ether, polybutylene terephthalate, nylon, polyamide, polycarbonate, polyacetal, polyphenylene sulfide, or polyether ether ketone.

In addition, the resins described above may be copolymerized or properties thereof may be changed, and examples of strains of the resins include styrene resin, acryl-based resin, styrene-acryl-based copolymer resin, olefin-based resin, vinyl chloride-based resin, polyester-based resin, polyamide-based resin, polyurethane-based resin, polyvinyl alcohol-based resin, vinyl ether-based resin, N-vinyl-based resin, or styrene-butadiene-based resin.

Examples of substances that are supplied from the binder supply unit 171A include a clumping inhibitor for inhibiting the fibers from clumping or the binder P1 from clumping, or a flame retardant for retarding progression of burning of fibers or the like, a paper strengthening agent for strengthening, paper strength of the sheet S, or the like, in addition to the binder P1. Otherwise, a substance obtained by mixing (compounding) the agents described above with the binder P1 in advance may be supplied from the binder supply unit 171A.

In addition, the color material supply unit 3A (first functional material supply unit) that supplies a color material CM1 as a first functional material is provided downstream of the binder supply unit 171A on the flow channel of the pipe 172A, and the color material supply unit 3B (second functional material supply unit) that supplies a color material CM2 as a second functional material is provided downstream of the binder supply unit 171B on the flow channel of the pipe 172B. Since the color material supply unit 3A and the color material supply unit 3B have the same configuration except that a type (color) of color material to be supplied is different from each other, hereinafter, the color material supply unit 3A will be representatively described.

As illustrated in FIG. 2, the color material supply unit 3A includes a storage section 31 that stores the color material CM1 and a flow channel 32 coupled to the storage section 31.

The storage section 31 is configured of a hollow body having a storage space 311 for storing the color material CM1 inside. The storage section 31 is detachably mounted on a mounting unit 33 provided in the sheet manufacturing apparatus 100. In this manner, in a mounting state, the storage space 311 of the storage section 31 communicates with the flow channel 32. Consequently, the color material CM1 can flow into the flow channel 32.

It is preferable that the storage section 31 be configured of a cartridge. Consequently, it is possible to replace the storage section 31 with a new storage section 31 in a case where the storage section 31 is empty, that is, the color material CM1 is used up. In addition, in the sheet manufacturing apparatus 100, a remaining amount of the color material CM1 in the storage section 31 is detected by a remaining amount detector (not illustrated).

As illustrated in FIGS. 2 and 3, the flow channel 32 is coupled to the storage section 31 upstream on the flow channel and is coupled to an inflow port 183 of the first material supply unit 18A downstream thereon. For example, the flow channel 32 is configured of a pipe 321. The pipe 321 is coupled at a position on the pipe 172A. Consequently, the color material CM1 is mixed with the mixture M6AP so as to become a mixture M7A as a first material. Similarly, in the pipe 172B, the color material CM2 is mixed with the mixture M6BP so as to become a mixture M7B as a second material.

In addition, as illustrated in FIG. 3, the pipe 172A diverges into two pipes at a position on the pipe, and the diverged pipes are coupled to respective inflow ports 183. Consequently, it is possible to supply the mixture M7A into the drum section 181.

One of the color material supply unit 3A (first functional material supply unit) and the color material supply unit 3B (second functional material supply unit) may be omitted.

Even in this case, the sheet manufacturing apparatus 100 includes at least one of the color material supply unit 3A (first functional material supply unit) that supplies the color material CM1 (first functional material) to the first material supply unit 18A and the color material supply unit 3B (second functional material supply unit) that supplies the color material CM2 (second functional material) to the second material supply unit 18B, and thus obtains the sheet S having functions (colors) different on the front and back sides from each other.

In addition, the sheet manufacturing apparatus 100 of the embodiment includes both of the color material supply unit 3A (first functional material supply unit) and the color material supply unit 3B (second functional material supply unit), and colors of the color material CM1 (first functional material) and the color material CM2 (second functional material) are different from each other. Also in this manner, the sheet S having colors different on the front and back sides from each other is obtained.

The color material supply-amount adjusting unit 4A adjusts supply of the color material CM1 from the color material supply unit 3A to the drum section 181, and the color material supply-amount adjusting unit 4B adjusts supply of the color material CM2 from the color material supply unit 3B to the drum section 181. Since the color material supply-amount adjusting unit 4A and the color material supply-amount adjusting unit 4B have the same configuration, hereinafter, the color material supply-amount adjusting unit 4A will be representatively described.

As described above, the color material supply unit 3A includes the flow channel 32 through which the color material CM1 passes. As illustrated in FIG. 2, the color material supply-amount adjusting unit 4A is provided on the flow channel 32 and includes a screw 411 inserted concentrically into the flow channel 32 (pipe 321) and a drive unit 412 that rotatably drives the screw 411. The screw 411 rotates, and thereby the color material CM1 can be extracted from the storage section 31 and can be extruded downstream as it is. Consequently, the color material CM1 can pass through the flow channel 32 so as to reach the drum section 181. In addition, the rotation of the screw 411 is stopped, and thereby it is also possible to stop extrusion of the color material CM1.

For example, the drive unit 412 is configured of a motor or the like. In addition, as illustrated in FIG. 5, the drive unit 412 is electrically coupled to the controller 28. Consequently, an operation of the drive unit 412 is controlled by the controller 28, and thereby it is possible to change a rotation speed of the screw 411. It is possible to adjust a supply amount of the supply rate of the color material CM1 depending on a level of the rotation speed of the screw 411, and thereby the sheet S having a desired shade of a color is obtained, for example. For example, operation information of the drive unit 412 is input and stored to the controller 28 in advance via an input unit such as a keyboard or a touch panel (not illustrated).

The color material CM1 and the color material CM2 are not particularly limited. For example, it is possible to use a pigment having a chromatic color, and examples thereof include a color such as cyan (C), yellow (Y), or magenta (M).

As illustrated in FIGS. 3 and 4, the mixture M7A as the first material obtained by mixing the subdivided bodies M6A, the binder P1, and the color material CM1 flows down through the pipe 172A so as to be supplied to the first material supply unit 18A, and the mixture M7B as the second material obtained by mixing the subdivided bodies M6B, the binder P2, and the color material CM2 flows down through the pipe 172B so as to be supplied to the second material supply unit 18B.

Since the first material supply unit 18A and the second material supply unit 18B have the same configuration except that installation positions thereof are different from each other and materials to be supplied (released) are different from each other, hereinafter, the first material supply unit 18A will be representatively described.

The first material supply unit 18A executes a step of accumulating the mixture M7A on a mesh belt 191 as a separation belt. The first material supply unit 18A has a drum section 181 and a housing section 182 that houses the drum section 181.

The drum section 181 of the first material supply unit 18A corresponds to the first drum section, the drum section 181 of the second material supply unit 18B corresponds to the second drum section.

The drum section 181 is a sieve that is configured of a net body having a circular cylinder shape and rotates around a center axis $O_{181}$ thereof. The mixture M7A flows into the drum section 181. In this manner, the drum section 181 rotates, and thereby a fiber or the like of the mixture M7A, which is smaller than a mesh opening of a net, can pass through the drum section 181. In this case, the mixture M7A is loosened.

A housing space, in which the mixture M7A is temporarily housed, is formed on an inner side (inside) of the drum section 181.

In addition, the drum section 181 is interconnected with a drive unit 187 (refer to FIG. 5) having a drive source such as a motor, a transmission, or the like, and thus an operation of the drive unit 187 enables the drum section 181 to rotate around the center axis $O_{181}$ at a predetermined rotation speed. The operation of the drive unit 187 is controlled by the controller 28, and it is possible to set and change the rotation speed of the drum section 181 in multiple levels.

As illustrated in FIG. 3, the drum section 181 is provided with a plurality of opening portions 181*a* that penetrate a circular cylinder-shaped wall. The opening portions 181*a* are holes which are open to an outer circumferential portion of the drum section 181 and through which the mixture M7A is passable. In this manner, when the drum section 181 rotates around the center axis $O_{181}$, of the plurality of opening portions 181*a*, the mixture M7A in the drum section 181 can pass downward from the opening portions 181*a* that are positioned on a lower side than a height of the center axis $O_{181}$. The mixture M7A in the drum section 181 rotates along with the drum section 181 and passes through the opening portions 181*a*, thereby, being loosened appropriately and smoothly.

A shape of the opening portion 181*a* in a plan view is not particularly limited. For example, the shape is preferably a circular shape, an elliptical shape, an oval shape, a polygonal shape, or the like. In addition, a size of the opening portion 181*a* in a plan view is not particularly limited. For example, in a case where the opening portion 181*a* has the circular shape, a diameter is preferably 0.5 mm or larger and 5 mm or smaller, and more preferably 1 mm or larger and 3 mm or smaller. In addition, a forming method of the opening portions 181*a* is not particularly limited. For example, it is possible to use a method of machining such as punching. In addition, of the machining, it is possible to use a method of laser machining or etching machining. In addition, it is possible to use a resin net, a metal net, and expanded metal as the drum section 181.

The drum section 181 may rotate around the center axis $O_{181}$ in one direction, may rotate (swing) around the center axis $O_{181}$ in opposite directions alternately, or may perform combined rotation thereof. In addition, the drum section 181 is not limited to a section that rotates. For example, the drum section may reciprocate in a center axis $O_{181}$ direction or a direction intersecting the center axis $O_{181}$, or may swing around a position separated from the center axis $O_{181}$.

In addition, the inflow ports 183, into which the mixture M7A flows, are coupled to both end portions of the drum section 181. For example, the inflow ports 183 have an annular shape, a circular cylinder shape, or a circular tubular shape and are inserted into inner sides of end portions of the drum section 181. In addition, the inflow ports 183 communicate with the pipe 172 downstream. Consequently, the mixture M7A that has passed through the pipe 172 can flow into the drum section 181 via the inflow ports 183.

In addition, the housing section 182 as a housing which houses the drum section 181 is opened on a lower side toward the mesh belt 191. Consequently, the mixtures M7A that have passed through the opening portions 181*a* of the drum section 181 fall down and are accumulated on the mesh belt 191.

The housing section 182 as a first housing section in the first material supply unit 18A is provided with an opening portion 182A as a first release port which is opened on a lower side. Similarly, the housing section 182 as a second housing section in the second material supply unit 18B is provided with an opening portion 182B that functions as a second release port.

The mixture M7A loosened in the drum section 181 is released and falls down from the opening portion 182A toward the second web former 19 that is positioned below the drum section 181. Similarly, the mixture M7B loosened in the drum section 181 of the second material supply unit 18B is released and falls down from the opening portion 182B toward the second web former 19 that is positioned below the drum section 181.

As described above, in the sheet manufacturing apparatus 100, the first material supply unit 18A includes the drum section 181 (first drum section) provided with the opening portion 181*a* as the hole, through which the mixture M7A (first material) is passable, and the housing section 182 (first housing section) that houses the drum section 181 (first drum section) and is provided with the opening portion 182A (first release port), and the second material supply unit 18B includes the drum section 181 (second drum section) provided with the opening portion 181*a* as the hole, through which the mixture M7B (second material) is passable, and the housing section 182 (second housing section) that houses the drum section 181 (second drum section) and is provided with the opening portion 182B (second release port).

Consequently, in a simple configuration in which the rotation speed of the drum section 181 is adjusted, it is possible to adjust the supply amounts of the mixture M7A and the mixture M7B. Further, since the housing sections 182 that house the drum sections 181, respectively, it is possible to stabilize an air current of a suction unit 193A and a suction unit 193B to be described below, and thus it is possible to effectively suppress an occurrence of a variation in thickness of a second web M8.

As illustrated in FIGS. 1 and 4, the second web former 19 is a transporting unit that forms the second web M8 while transporting the mixture M7A and the mixture M7B and executes the second web forming step. The second web former 19 includes the mesh belt 191, a plurality of stretching rollers 192, and a suction unit (suction mechanism) 193.

The mesh belt 191 is a movable endless belt and accumulates the mixture M7A and the mixture M7B. The mesh belt 191 loops around four stretching rollers 192. In this manner, the stretching rollers 192 are rotatably driven, and thereby the mixture M7A and the mixture M7B on the mesh belt 191 are transported downstream.

In addition, almost all of the mixture M7A and the mixture M7B on the mesh belt 191 have a size equal to or larger than a mesh opening of the mesh belt 191. Consequently, the mixture M7A and the mixture M7B are restricted from passing through the mesh belt 191, and thereby it is possible to accumulate the mixtures on the mesh belt 191. In addition, the mixture M7A and the mixture M7B are transported along with the mesh belt 191 downstream while being accumulated on the mesh belt 191 and, thus, are formed into the layer-shaped second web M8. As will be described below, the second web M8 as an accumulated substance obtained by accumulating the mixture M7A and the mixture M7B becomes a laminate in which a layer of the mixture M7A and a layer of the mixture M7B are laminated.

In addition, at least one stretching roller 192 is interconnected with a drive unit 194 (refer to FIG. 5) having a drive source such as a motor, a transmission, or the like, and thus an operation of the drive unit 194 enables the stretching roller to rotate at a predetermined rotation speed. The operation of the drive unit 194 is controlled by the controller 28, and it is possible to change (set, in multiple levels) the rotation speed of the stretching roller 192.

A suction unit 193 is capable of suctioning air from below the mesh belt 191 with respect to accumulation surfaces of the mixture M7A and the mixture M7B. In other words, the layer of mixture M7A (first material) and the layer of mixture M7B (second material) accumulated on an upper surface side (one surface side) of the mesh belt 191 are suctioned from a lower surface side (the other surface side) of the mesh belt 191. Consequently, the mixture M7A and the mixture M7B are promoted to be accumulated on the mesh belt 191, and it is possible to suppress an occurrence of a variation in thickness of the formed second web M8.

The suction unit 193 includes the suction unit 193A as a first suction unit and the suction unit 193B as a second suction unit provided downstream of the suction unit 193A (first suction unit) in the transporting direction.

A pipe (flow channel) 246 is coupled to each of the suction unit 193A and the suction unit 193B. In addition, the blower 263 is installed at a position on the pipe 246. An operation of the blower 263 can generate a suction force by the suction unit 193A and the suction unit 193B.

As described above, in the sheet manufacturing apparatus 100, the second web former 19 (transporting unit) includes the mesh belt 191 that is movable in the transporting direction and the suction unit 193 that suctions the layer of the mixture M7A (first material) and the layer of the mixture M7B (second material) accumulated on one surface side (upper surface side) of the mesh belt 191, from the other surface side (lower surface side) of the mesh belt 191. Consequently, it is possible to promote accumulation of the mixture M7A and the mixture M7B on the mesh belt 191, and it is possible to suppress the occurrence of a variation in thickness of the formed second web M8.

The housing section 182 is coupled to the humidifying unit 234. The humidifying unit 234 is configured of the same vaporization-type humidifier as the humidifying unit 231. Consequently, the humidified air is supplied into the housing section 182. It is possible to humidify the inside of the housing section 182 with the humidified air, and thereby it is possible to suppress attachment of the mixture M7A and the mixture M7B to an inner wall of the housing section 182 due to an electrostatic force.

As illustrated in FIG. 1, the forming unit 20 is disposed downstream of the second web former 19. The forming unit 20 executes the sheet forming step of forming the sheet S from the second web M8. The forming unit 20 includes a pressurizing unit 201 and a heating unit 202.

The pressurizing unit 201 includes a pair of calendar rollers 203 and is capable of pressurizing the second web M8 between the pair of calendar rollers 203 without heating the second web, that is, without melting the binder P1. Consequently, the density of the second web M8 increases. In this manner, the second web M8 is transported toward the heating unit 202. One of the pair of calendar rollers 203 is a drive roller that is driven by an operation of a motor (not illustrated), and the other roller is a driven roller.

The heating unit 202 includes a pair of heating rollers 204 and is capable of pressurizing the second web M8 while heating the second web between the pair of heating rollers 204. The binder P1 is melted in the second web M8 through heating and pressurizing such that fibers are bound to each other via the melted binder P1. Consequently, the sheet S is formed. In this manner, the sheet S is transported toward the cutter 21. One of the pair of heating rollers 204 is a drive roller that is driven by an operation of a motor (not illustrated), and the other roller is a driven roller.

The cutter 21 is disposed downstream of the forming unit 20. The cutter 21 executes the cutting step of cutting the sheet S. The cutter 21 includes a first cutter 211 and a second cutter 212.

The first cutter 211 cuts the sheet S in a direction intersecting the transporting direction of the sheet S.

The second cutter 212 cuts the sheet S in a direction parallel to the transporting direction of the sheet S downstream of the first cutter 211.

The sheet S having a desired size is obtained through cutting by the first cutter 211 and the second cutter 212. In this manner, the sheet S is transported further downstream and is accumulated in the stock unit 22.

However, as described above, the second web M8 (accumulated substance) obtained by accumulating the mixture M7A and the mixture M7B on the mesh belt 191 becomes the laminate in which the layer of the mixture M7A and the layer of the mixture M7B are laminated. Hereinafter, laminating thereof will be described.

As illustrated in FIGS. 1 and 4, the sheet manufacturing apparatus 100 includes the first material supply unit 18A and the second material supply unit 18B. The opening portion 182A (first release port) of the housing section 182 (first housing section) of the first material supply unit 18A and the opening portion 182B (second release port) of the housing section 182 (second housing section) of the second material supply unit 18B are formed at different positions from each other in the transporting direction of the mesh belt 191. In the sheet manufacturing apparatus 100, the opening portion 182B (second release port) is positioned downstream of the opening portion 182A (first release port) in the transporting direction of the mesh belt 191.

Therefore, the mixture M7A (first material) released from the opening portion 182A upstream in the transporting direction is first accumulated on the mesh belt 191, and then the mixture M7B (second material) released from the opening portion 182B downstream in the transporting direction is accumulated. Accordingly, the second web M8 which is the laminate obtained by laminating the layer of mixture M7A and the layer of mixture M7B is formed on the mesh belt 191. The second web M8 is transported by the mesh belt 191 and is heated and pressurized by the forming unit 20, and thereby it is possible to bind the layer of mixture M7A and the layer of mixture M7B and obtain the two-layer configured sheet S.

In addition, as described above, the colors of the color material CM1 of the mixture M7A and the color material CM2 of the mixture M7B are different from each other, and thus the sheet S has colors different on the front and back sides from each other.

Here, the mixture M7A contains the binder P1 (first organic binder), and the mixture M7B contains the binder P2 (second organic binder). Therefore, when the second web M8 is heated and pressurized, the binder P1 and the binder P2 come into a melted or softened state, and thus movement of the color material CM1 or the color material CM2 in a gap between fibers is suppressed. Accordingly, it is possible to reduce an occurrence of mixing of the layer of mixture M7A with the layer of mixture M7B. As a result, it is possible to clearly form an interface between the layer of mixture M7A and the layer of mixture M7B, and it is possible to manufacture the sheet S having colors different on the front and back sides from each other. In other words, it is possible to manufacture the sheet S having a desired color with high accuracy.

In addition, the second web M8 is heated and pressurized, and thereby the binder P1 and the binder P2 are bonded to each other, rather than a case where bonding between the layer and the layer is performed by using water in a fiber layer. Thus, it is possible to obtain the sheet S of which interlayer peeling is more reduced.

In addition, as described above, in a case where fibers contained in the mixture M7A and the mixture M7B are natural fibers, effects of the present disclosure is more remarkably achieved.

In addition, in the sheet manufacturing apparatus 100, the rotation speed of the drum sections 181 is adjusted, and thereby it is possible to adjust a thickness of the layer of mixture M7A and a thickness of the layer of mixture M7B in the second web M8. In other words, in the embodiment, the drum sections 181 function as a supply-amount adjusting unit that adjusts supply amounts of the mixture M7A and the mixture M7B.

The thickness of the layer of mixture M7A and the thickness of the layer of mixture M7B are adjusted, and thereby it is possible to adjust a hue in the sheet S after forming. For example, when the sheet is viewed from a side of a layer having a smaller thickness of the layer of mixture M7A and the layer of mixture M7B, a hue of the other (back side) layer is viewed to be mixed. However, when the sheet is viewed from a side of a layer having a larger thickness, a color of the layer is viewed to be emphasized.

By changing at least one rotation speed of the plurality of drum sections 181, it is possible to exhibit the effect. In other words, the sheet manufacturing apparatus 100 includes the supply-amount adjusting unit that adjusts at least one of the supply amount of the mixture M7A (first material) and the supply amount of the mixture M7B (second material), and thereby it is possible to adjust at least one (in the embodiment, both) of the thickness of the layer of mixture M7A and the thickness of the layer of mixture M7B. As a result, it is possible to achieve the effect described above.

In addition, in the embodiment, there is described a case where the adjustment of the supply amount of the mixture M7A (first material) and the supply amount of the mixture M7B (second material) is performed through the adjustment of the rotation speed of the drum sections 181. However, the embodiment is not limited thereto, and a configuration may be employed, in which sizes of the opening portions 181*a* of the drum sections 181 are changed, or the supply amount of the mixture M7A or the mixture M7B to the drum section 181 is adjusted. In addition, a degree of a movement speed of the mesh belt 191 may be adjusted. When the movement speed of the mesh belt 191 is increased, it is possible to decrease the thickness of the layer of mixture M7A or the thickness of the layer of mixture M7B. Conversely, when the movement speed of the mesh belt 191 is decreased, it is possible to increase the thickness of the layer of mixture M7A or the thickness of the layer of mixture M7B.

The amount of the mixture M7A that is released from the opening portion 182A and the amount of the mixture M7B that is released from the opening portion 182B may be the same as each other.

In addition, as described above, the suction unit 193 includes the suction unit 193A (first suction unit) and the suction unit 193B (second suction unit) provided downstream of the suction unit 193A (first suction unit) in the transporting direction. The suction unit 193A mainly has a function of suctioning the mixture M7A released from the first material supply unit 18A and the layer of mixture M7A accumulated on the mesh belt 191. The suction unit 193B mainly has a function of suctioning the mixture M7B released from the second material supply unit 18B and the second web M8 (laminate) accumulated on the mesh belt 191. It is possible to promote accumulation of the layer of mixture M7A and the layer of mixture M7B sequentially by the suction unit 193A and the suction unit 193B, and it is possible to suppress the occurrence of a variation in thickness of the second web M8.

In addition, in the sheet manufacturing apparatus 100, a suction force of the suction unit 193B is stronger than a suction force of the suction unit 193A. In other words, the suction force of the suction unit 193B that mainly suctions the mixture M7B and the second web M8 (laminate) is stronger than the suction force of the suction unit 193A that mainly suctions the mixture M7A and the layer of mixture M7A. Consequently, it is possible to appropriately suction the second web M8 (accumulated substance) on the mesh belt 191 as uniform as possible. As a result, it is possible to more effectively suppress the occurrence of the variation in thickness of the second web M8.

In addition, in the sheet manufacturing apparatus 100, the suction forces of the suction unit 193A and the suction unit 193B may be adjusted depending on accumulation amounts (release amounts) of the mixture M7A and the mixture M7B.

As described above, the web forming device 1 includes: the first material supply unit 18A that is provided with the opening portion 182A (first release port) that releases the mixture M7A (first material) containing the subdivided bodies M6A (first defibrated substance) and the binder P1 (first organic binder) in the gas atmosphere; the second material supply unit 18B that is provided with the opening portion 182B (second release port) that releases the mixture M7B (second material) in the gas atmosphere, the mixture M7B containing the subdivided bodies M6B (second defibrated substance) and the binder P2 (second organic binder) and being different from the mixture M7A (first material); and the second web former 19 (transporting unit) that forms and transports the accumulated substance obtained by accumulating the mixture M7A (first material) and the mixture M7B (second material). The opening portion 182B (second release port) of the second material supply unit 18B is positioned downstream of the opening portion 182A (first release port) of the first material supply unit 18A in the transporting direction of the second web former 19 (transporting unit), and the second web M8 (accumulated substance) is the laminate obtained by laminating the layer of the mixture M7A (first material) and the layer of the mixture M7B (second material).

Consequently, when the obtained second web M8 is heated and pressurized so as to form the sheet S, it is possible to reduce an occurrence of mixing of the layer of mixture M7A with the layer of mixture M7B. Accordingly, it is possible to laminate the layers having different functions (in the embodiment, colors) from each other and manufacture the sheet S having a reduction in mixing of the layer and the layer.

In addition, the sheet manufacturing apparatus 100 includes: the web forming device 1; and a forming unit 20 (forming unit) that heats and pressurizes the second web M8 (laminate) so as to form the second web M8 into a sheet shape. The second web M8 is heated and pressurized, and thereby the binder P1 and the binder P2 are thermally bound, the interface between the layer of mixture M7A and the layer of mixture M7B is clearly formed, and it is possible to increase bonding strength between the layers. Therefore, as described above, it is possible to obtain the sheet S having a more reduction in mixing of the layer of mixture M7A and the layer of mixture M7B, and it is possible to obtain the sheet S having the high strength.

In the embodiment, there is described a case where the first material supply unit 18A (the drum section 181 and the housing section 182) and the second material supply unit 18B (the drum section 181 and the housing section 182) are aligned in the transporting direction of the mesh belt 191. However, the present disclosure is not described thereto, and a positional relationship between the drum section 181 and the housing section 182 of the first material supply unit 18A and the drum section 181 and the housing section 182 of the second material supply unit 18B is not particularly limited, as long as the opening portion 182A of the first material supply unit 18A and the opening portion 182B of the second material supply unit 18B are aligned in the transporting direction of the mesh belt 191.

For example, the present disclosure also includes a configuration in which the drum section 181 of the first material supply unit 18A and the drum section 181 of the second material supply unit 18B are aligned along the y axis or the z axis, as long as the opening portions 182A and 182B are configured (shaped) to satisfy the positional relationship described above.

In addition, there is described a configuration in which the drum section 181 rotates, and thereby the first material supply unit 18A releases the mixture M7A. However, the present disclosure is not limited thereto and, instead of the drum section 181, a configuration in which the mixture M7A is ejected in a spraying manner or a configuration in which the mixture M7A falls down by opening and closing a shutter may be employed. The same is true of the second material supply unit 18B.

In addition, in the embodiment, there is described a case where the color material supply unit 3A is provided between the binder supply unit 171A of the pipe 172A and the first material supply unit 18A. However, the present disclosure is not limited thereto, and the color material supply unit may be provided downstream of the diverged portion of the pipe 172 and at a position at which the color material is finally supplied to the first material supply unit 18A. For example, a configuration in which the color material is supplied into the drum section 181 or a configuration in which the color material is supplied to the binder supply unit 171A may be employed, and the color material supply unit may be provided upstream of the binder supply unit 171A. The same is true of the color material supply unit 3B.

In addition, the embodiment employs a configuration in which the subdivided bodies M6 are distributed to the pipe 172A and the pipe 172B at a position on the pipe 172 by substantially the same amount, that is, the subdivided bodies M6A (first defibrated substance) and the subdivided bodies M6B (second defibrated substance) are substantially the same amount. However, the present disclosure is not limited thereto, and a configuration may be employed, in which an electromagnetic valve is provided in the diverged portion of the pipe 172 and the electromagnetic valve is controlled, and thereby a distribution rate of the subdivided bodies M6 to the pipe 172A and the pipe 172B is controlled. In addition, a configuration may be employed, in which an on-off valve that is capable of adjusting a degree of opening and closing of the pipe 172A and the pipe 172B is provided such that amounts of the subdivided bodies M6A as the first defibrated substance and the subdivided bodies M6B as the second defibrated substance are adjusted. Consequently, it is possible to adjust the thickness of the layer of mixture M7A and the thickness of the layer of mixture M7B in the second web M8.

In addition, in the embodiment, there is described a case where the color material CM1 and the color material CM2 as the first functional material and the second functional material have different colors from each other. However, the present disclosure is not limited thereto, and the first functional material and the second functional material may have the same color as each other. In this case, materials of the first defibrated substance and the second defibrated substance may be different from each other, materials of the binder P1 (first organic binder) and the binder P2 (second organic binder) may be different from each other, or both the different materials of the defibrated substances and the different materials of the binders may be employed. In other words, any of the cases is included in the present disclosure except that the first material and the second material are not completely the same.

In addition, the present disclosure includes even a case where the materials of the subdivided bodies M6A (first defibrated substance) and the subdivided bodies M6B (second defibrated substance) are the same as each other, the materials of the binder P1 (first organic binder) and the binder P2 (second organic binder) are the same as each other, and the materials of the color material CM1 (first functional material) and the color material CM2 (second functional material) are the same as each other, when mixing is performed by different compounding ratios (content ratios) thereof, and thus the mixture M7A (first material) and the mixture M7B (second material) are different from each other.

In addition, in the embodiment, there is described a case where the color material CM1 and the color material CM2 as the first functional material and the second functional material are the color materials having chromatic colors. However, the present disclosure is not limited thereto. For example, the color material may be a resin material (resin powder or resin fiber) that is transparent or has an achromatic color such as white, a metal material (metal powder or metal fiber), or the like, or the first functional material and the second functional material may be a combination of different materials such as a combination of a color material having a chromatic color and a resin material having an achromatic color, a combination of a resin material having a chromatic color and a metal material, or a combination of resin powder having an achromatic color and a metal material.

In a case of using the resin material having the achromatic color, a supply amount thereof is adjusted, and thereby it is possible to adjust a degree of surface gloss depending on a use.

Examples of the metal materials include aluminum, iron, silver, copper, or nickel. In a case of using the metal material, the sheet S having relatively low water vapor permeability is obtained and can be used for food packaging or the like, for example. In addition, in a case of using the metal material, the sheet S having conductivity is obtained and can be used as an antistatic sheet. In addition, in a case of using the metal material, the obtained sheet as an unnecessary radiation sheet (electromagnetic wave shielding sheet) can be used for a housing or the like of an electronic device. In addition, in a case of using a metal material (for example, silver) having an antibiotic property, the sheet can be used as an antibacterial sheet, a sterilizing sheet, a deodorizing sheet.

Second Embodiment

Figure 6:
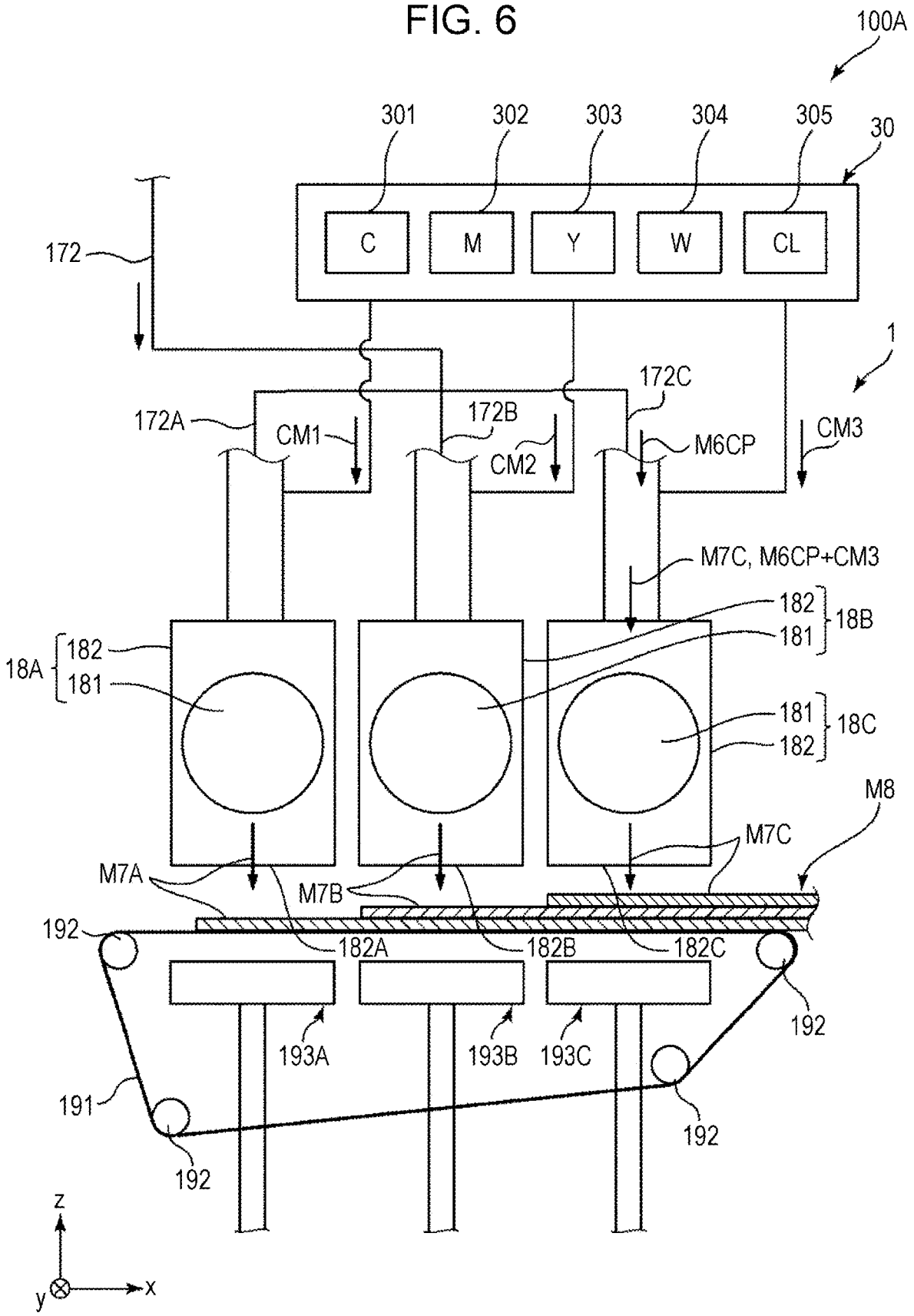
FIG. 6 is a schematic side view illustrating a first material supply unit, a second material supply unit, a third material supply unit, and a periphery thereof included in a sheet manufacturing apparatus of a second embodiment to which the present disclosure is applied.
Figure 7:
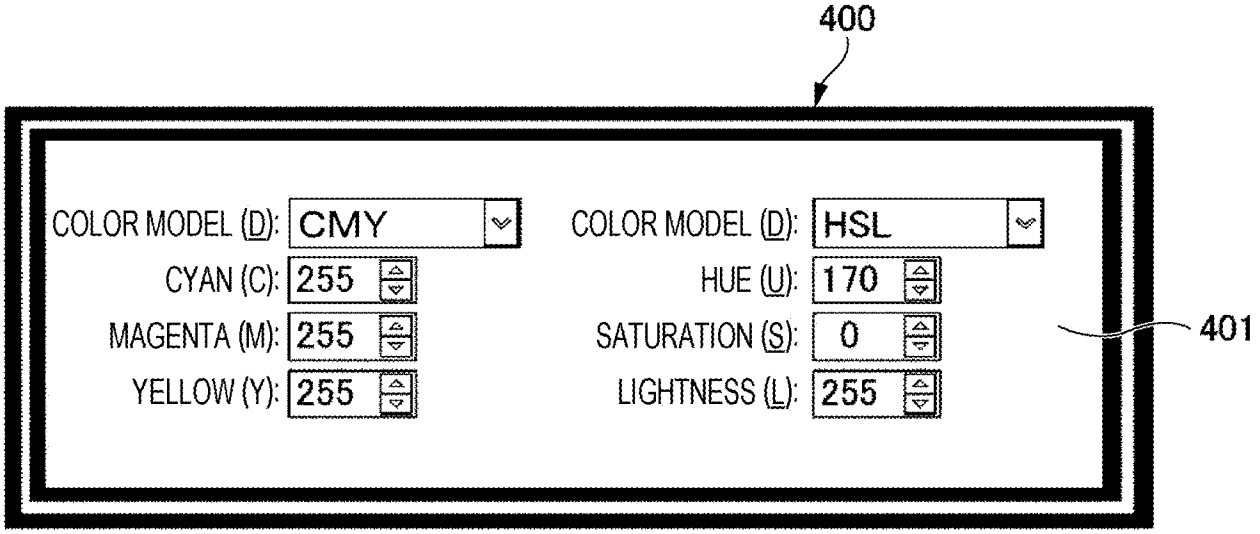
FIG. 7 is a view illustrating an example of a screen of an input device included in the sheet manufacturing apparatus illustrated in FIG. 6.
Figure 8:
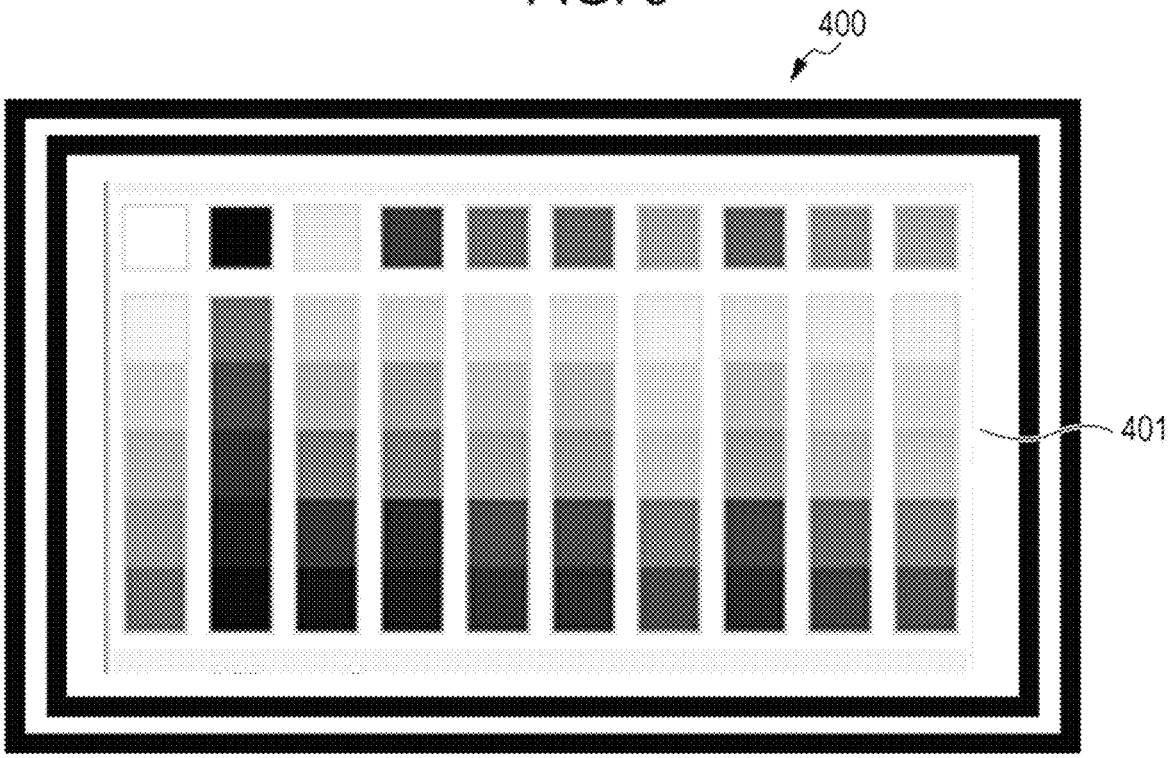
FIG. 8 is a view illustrating an example of a screen of the input device included in the sheet manufacturing apparatus illustrated in FIG. 6.
Figure 9:
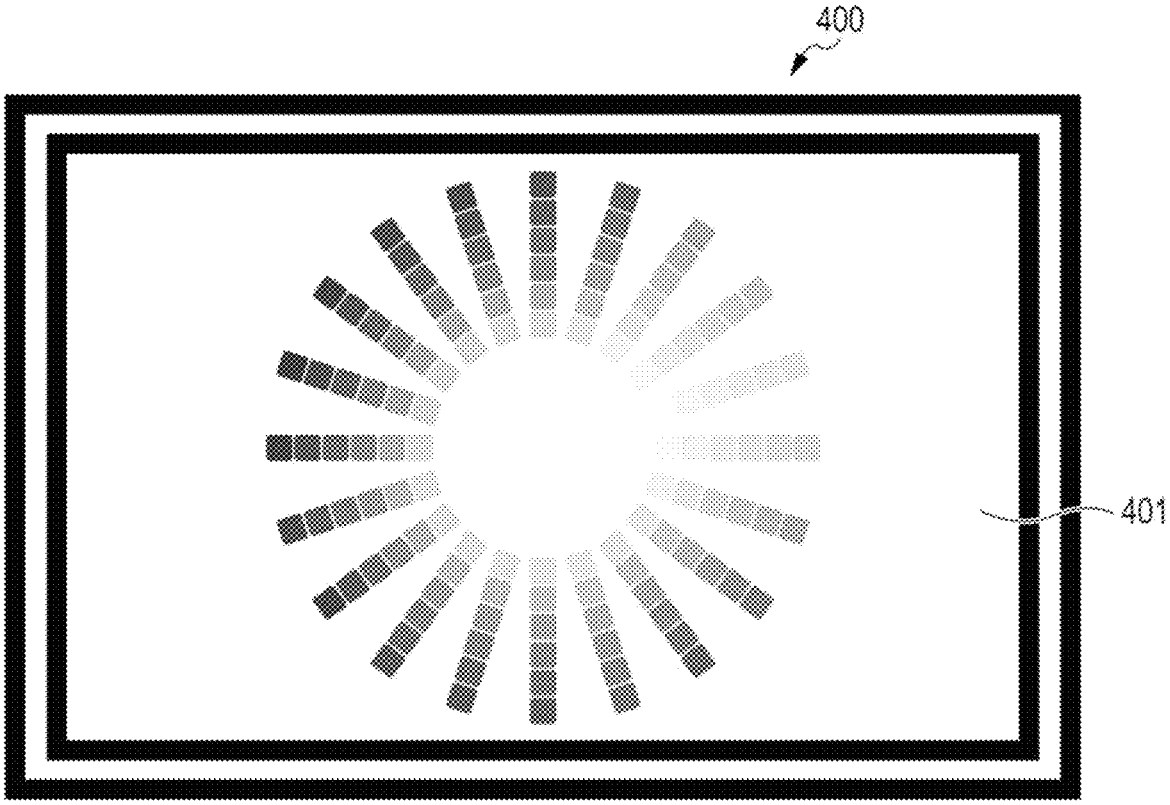
FIG. 9 is a view illustrating an example of a screen of the input device included in the sheet manufacturing apparatus illustrated in FIG. 6.
Figure 10:
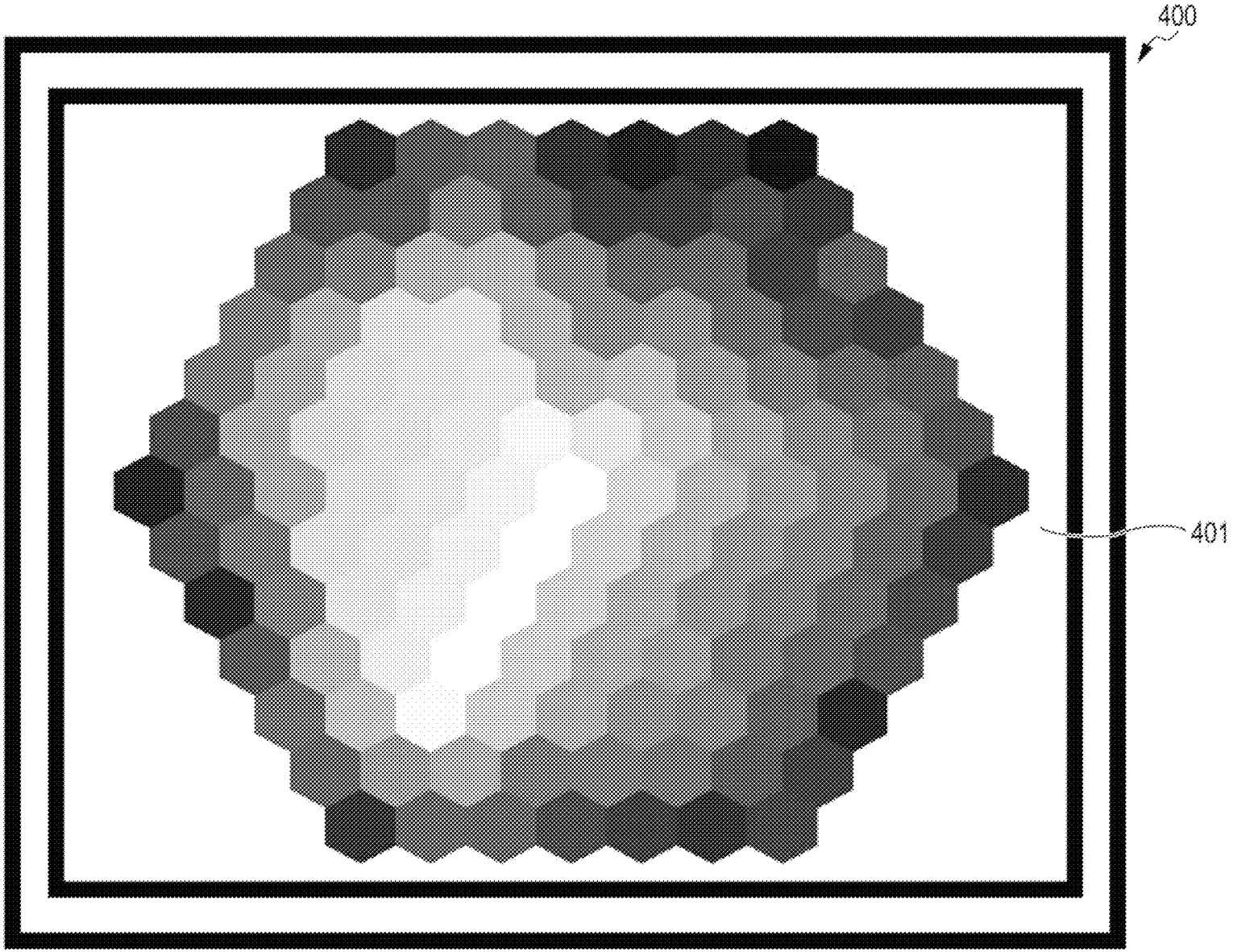
FIG. 10 is a view illustrating an example of a screen of the input device included in the sheet manufacturing apparatus illustrated in FIG. 6.

FIG. 6 is a schematic side view illustrating the first material supply unit, the second material supply unit, a third material supply unit, and a periphery thereof included in the sheet manufacturing apparatus (second embodiment) to which the web forming device of the present disclosure is applied. FIG. 7 is a view illustrating an example of a screen of an input device included in the sheet manufacturing apparatus illustrated in FIG. 6. FIG. 8 is a view illustrating an example of a screen of the input device included in the sheet manufacturing apparatus illustrated in FIG. 6. FIG. 9 is a view illustrating an example of a screen of the input device included in the sheet manufacturing apparatus illustrated in FIG. 6. FIG. 10 is a view illustrating an example of a screen of the input device included in the sheet manufacturing apparatus illustrated in FIG. 6.

Hereinafter, the second embodiment of the web forming device of the present disclosure will be described with reference to the drawings by focusing on differences from the embodiment described above, and the description of the same items is omitted.

The embodiment is the same as the first embodiment described above except that the color material supply unit has a different configuration and a third material supply unit is provided.

As illustrated in FIG. 6, the sheet manufacturing apparatus 100A further includes a third material supply unit 18C, in addition to the first material supply unit 18A and the second material supply unit 18B. In the embodiment, the pipe 172 diverges into three pipes which are the pipe 172A, the pipe 172B, and a pipe 172C, and the pipe 172C is coupled to the third material supply unit 18C. In addition, a binder supply unit 171C that supplies a binder P3 as a third organic binder is provided at a position on the pipe 172C. Therefore, in the pipe 172C, a mixture M7CP containing subdivided bodies M6C as a third defibrated substance and the binder P3 (third organic binder) is generated. In this manner, in the pipe 172C, a color material CM3 to be described below is mixed with the mixture M7CP such that a mixture M7C is generated, and the generated mixture is supplied to the third material supply unit 18C.

The third material supply unit 18C has the same configuration as that of the first material supply unit 18A and the second material supply unit 18B, however, an opening portion 182C as a third release port in the housing section 182 is positioned downstream of the opening portion 182B (second release port) of the second material supply unit 18B. In addition, the opening portion 182C of the third material supply unit 18C releases the mixture M7C different from the mixture M7B.

In addition, the sheet manufacturing apparatus 100A includes the suction unit 193A, the suction unit 193B, and a suction unit 193C. The suction unit 193A, the suction unit 193B, and suction unit 193C are disposed to be aligned in this order from upstream in the transporting direction.

Next, a color material supply unit 30 will be described.

As illustrated in FIG. 6, the color material supply unit 30 includes a storage section 301 that stores a color material CM(C) of cyan (C), a storage section 302 that stores a color material CM(M) of magenta (M), a storage section 303 that stores a color material CM(Y) of yellow (Y), a storage section 304 that stores a color material CM(W) of white (W), and a storage section 305 that stores a clear (colorless transparent) color material CM(CL). In addition, the color material supply unit 30 is capable of selectively supplying the color materials in the storage sections 301 to 305 individually to the pipe 172A, the pipe 172B, and the pipe 172C.

The color material supply unit 30 can have a configuration in which, although not illustrated, for example, the storage section 301 is coupled to each of the pipe 172A, the pipe 172B, and the pipe 172C via three piping systems, the storage section 302 is coupled to each of the pipe 172A, the pipe 172B, and the pipe 172C via three piping systems, the storage section 303 is coupled to each of the pipe 172A, the pipe 172B, and the pipe 172C via three piping systems, the storage section 304 is coupled to each of the pipe 172A, the pipe 172B, and the pipe 172C via three piping systems, the storage section 305 is coupled to each of the pipe 172A, the pipe 172B, and the pipe 172C via three piping systems, and on-off valves are provided on the fifteen piping systems. The on-off valves are each controlled by a control unit (not illustrated), and thereby it is possible to select color materials that are to be supplied to the first material supply unit 18A, the second material supply unit 18B, and the third material supply unit 18C.

In addition, a degree of opening of the on-off valves is controlled, and thereby it is possible to adjust a supply amount of the color material CM(C), the color material CM(M), the color material CM(Y), the color material CM(W), and the color material CM(CL).

In addition, opening and closing of the on-off valves are selected and the degree of opening of the on-off valves is adjusted, and thereby it is possible to select a color obtained by mixing (color mixing) the color material CM(C), the color material CM(M), the color material CM(Y), the color material CM(W), and the color material CM(CL).

For example, a selection screen 401 is displayed on a display device 400 (input device) as illustrated in FIGS. 7 to 10 such that a user performs selection, and thereby it is possible to realize a combination of selected colors. In addition, the display device 400 can be installed in any region of the sheet manufacturing apparatus 100 and can be a touch panel type display device. The display device 400 is electrically coupled to the controller and transmits a signal containing information of color selected by the user to the controller. As described above, the controller determines a color material and a supply amount thereof based on the information and adjusts a color. For example, the determination can be performed based on a calibration curve, a table, or the like stored in the storage unit (not illustrated) in advance.

In addition, in the embodiment, the sheet S to be obtained has a three-layer configuration, and thus the user selects each color of three layers.

Hereinafter, an example of the selection screen 401 that is displayed by the display device 400 will be described.

The selection screen 401 illustrated in FIG. 7 displays two items for selecting color models, an item for selecting density of cyan (C), an item for selecting density of magenta (M), an item for selecting density of yellow (Y), an item for selecting hue, an item for selecting saturation, and an item for selecting lightness. Selection switches having an imitated shape of an arrow in an up-down direction, which is set next to each of the items, are touched, and thereby it is possible to adjust the items.

In addition, in the selection screen 401 illustrated in FIG. 8, a matrix form in which mass of different colors are arranged in a matrix shape is displayed. In a configuration illustrated in FIG. 8, basic colors are disposed to be aligned horizontally in the uppermost row, and masses of colors having different brightness are disposed to be vertically aligned. The user touches the mass, and the color thereof is selected.

In addition, in the selection screen 401 illustrated in FIG. 9, columns of masses having different brightness from each other are separated from each other and are disposed in a radial shape. Each of the columns has different color. In a configuration illustrated in FIG. 9, brightness decreases from the center side toward the circumferential side in each column. The user touches the mass, and the color thereof is selected.

In addition, in the selection screen 401 illustrated in FIG. 10, color masses, of which at least one of the color and the brightness is different from each other, are spread and form a hexagonal shape overall. In addition, color masses having high brightness are disposed on the center side, and color masses having low brightness are disposed on the outer side. In addition, color masses having similar colors are disposed to be positioned close to each other. The user touches the mass, and the color thereof is selected.

According to such a sheet manufacturing apparatus 100A, color variations of the sheet S to be manufactured increase. In particular, since the sheet has the three-layer configuration, the sheet S is viewed to have a combined color of colors of a layer on a front side and a middle layer when the sheet is viewed from the front side, and the sheet S is viewed to have a combined color of colors of a layer on a back side and the middle layer when the sheet is viewed from the back side. In other words, the layer on the front side and the layer on the back side are unlikely to influence each other. As a result, it is possible to obtain the sheet S having a desired color with high accuracy.

As described above, the sheet manufacturing apparatus 100A includes the third material supply unit 18C provided with the opening portion 182C (third release port) that releases the mixture M7C (third material) in the gas atmosphere, the mixture containing the subdivided bodies M6C (third defibrated substance) and the binder P3 (third organic binder) and being different from the mixture M7B (second material). The opening portion 182C (Third release port) of the third material supply unit 18C is positioned downstream of the opening portion 182B (second release port) of the second material supply unit 18B in the transporting direction of the transporting unit.

According to the configuration, the second web M8 accumulated on the mesh belt 191 becomes a laminate obtained by accumulating the mixture M7A, the mixture M7B, and the mixture M7C in this order from a side of the mesh belt 191. Accordingly, the laminate is heated and pressurized by the forming unit 20, and thereby it is possible to obtain the sheet S having a more reduction in mixing of the layer of mixture M7A, the layer of mixture M7B, and the layer of mixture M7C.

Third Embodiment

Figure 11:
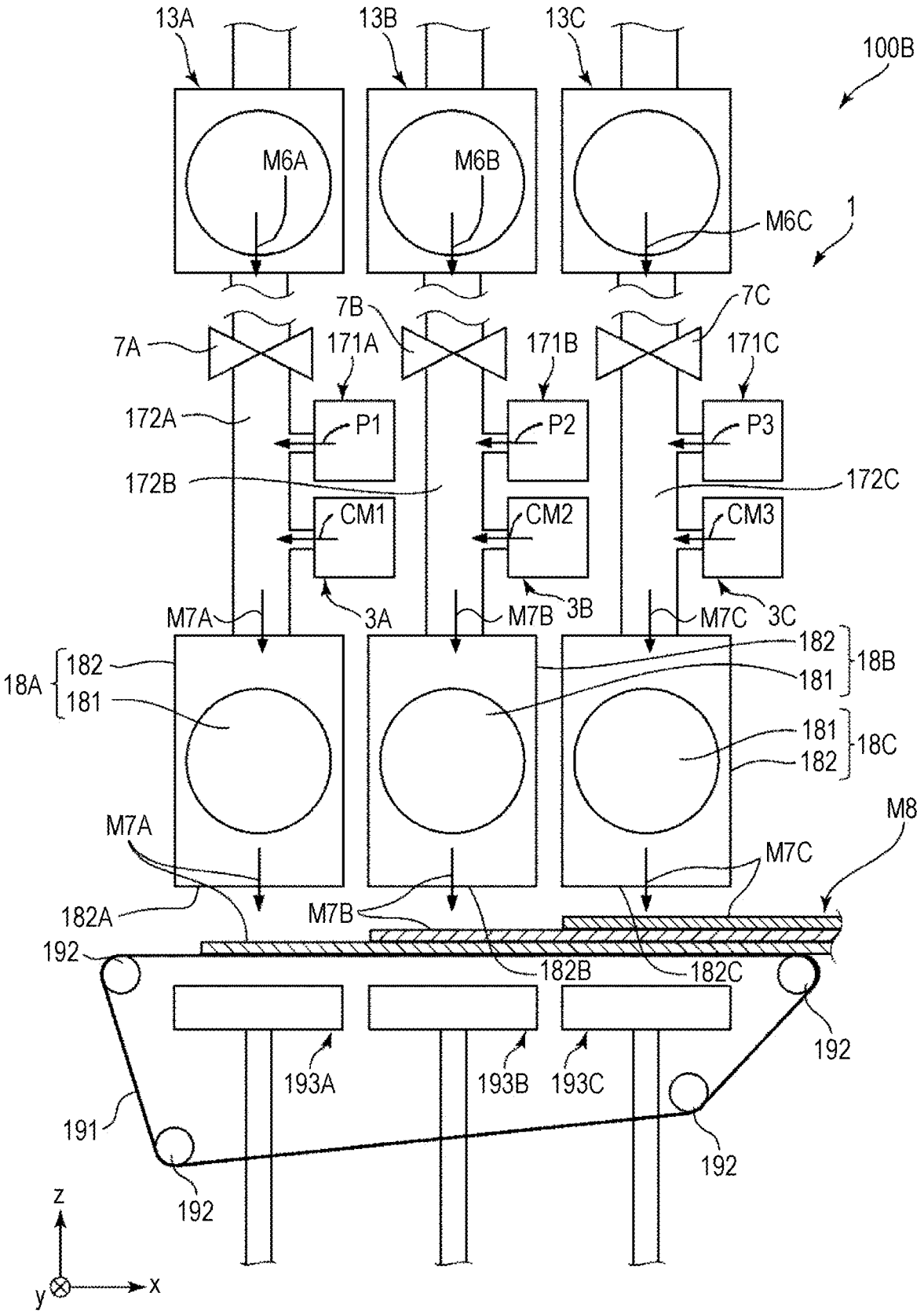
FIG. 11 is a schematic side view illustrating a first material supply unit, a second material supply unit, a third material supply unit, and a periphery thereof included in a sheet manufacturing apparatus of a third embodiment to which the present disclosure is applied.
Figure 12:
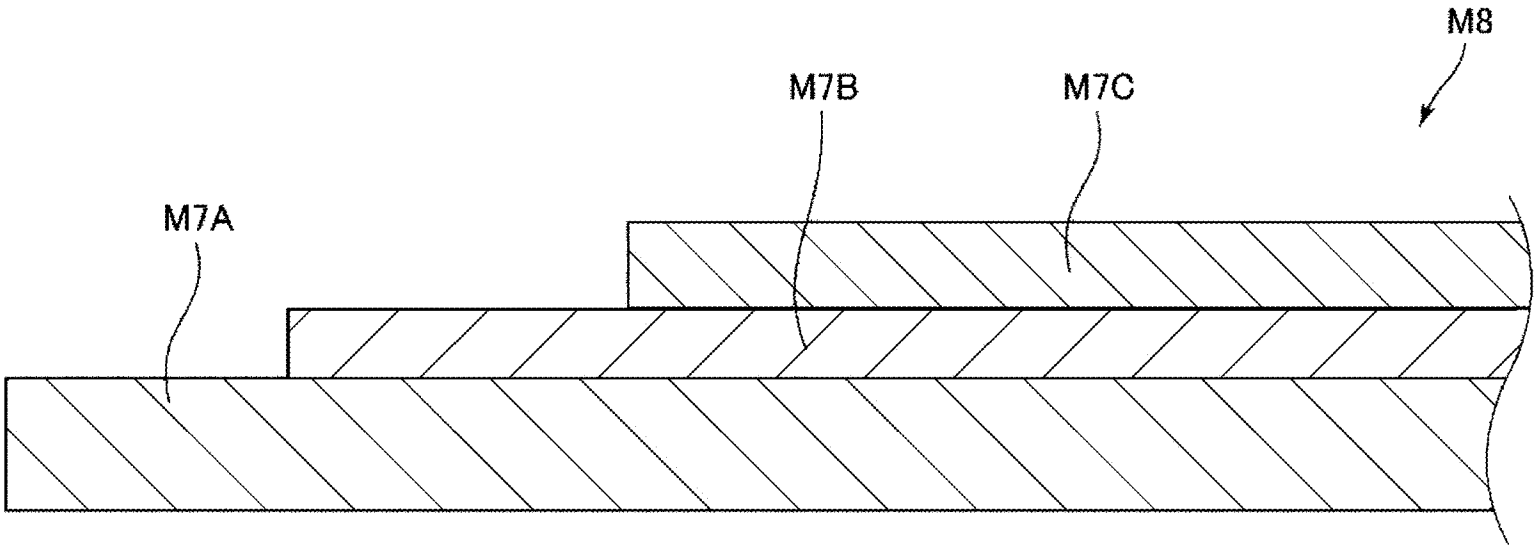
FIG. 12 is a sectional view illustrating an example of a second web (accumulated substance) that is manufactured by the sheet manufacturing apparatus illustrated in FIG. 11.

FIG. 11 is a schematic side view illustrating the first material supply unit, the second material supply unit, the third material supply unit, and a periphery thereof included in the sheet manufacturing apparatus (third embodiment) to which the web forming device of the present disclosure is applied. FIG. 12 is a sectional view illustrating an example of the second web (accumulated substance) that is manufactured by the sheet manufacturing apparatus illustrated in FIG. 11.

Hereinafter, the third embodiment of the web forming device of the present disclosure will be described with reference to the drawings by focusing on differences from the embodiments described above, and the description of the same items is omitted.

The embodiment is substantially the same as the second embodiment described above except for the number of installed defibration units.

As illustrated in FIG. 11, a sheet manufacturing apparatus 100B includes three defibration units of a first defibration unit 13A, a second defibration unit 13B, and a third defibration unit 13C. The first defibration unit 13A is coupled to the first material supply unit 18A via the pipe 172A. The second defibration unit 13B is coupled to the second material supply unit 18B via the pipe 172B. The third defibration unit 13C is coupled to the third material supply unit 18C via the pipe 172C.

In the embodiment, the pipe 242 (refer to FIG. 1) diverges into three pipes at a position on the pipe, and the three pipes are coupled to the first defibration unit 13A, the second defibration unit 13B, and the third defibration unit 13C, respectively.

In addition, an on-off valve 7A (regulator) is provided on the pipe 172A, and thus it is possible to adjust a supply amount of the subdivided bodies M6A defibrated in the first defibration unit 13A to the first material supply unit 18A. An on-off valve 7B is provided on the pipe 172B, and thus it is possible to adjust a supply amount of the subdivided bodies M6B defibrated in the second defibration unit 13B to the second material supply unit 18B. An on-off valve 7C is provided on the pipe 172C, and thus it is possible to adjust a supply amount of the subdivided bodies M6C defibrated in the third defibration unit 13C to the third material supply unit 18C.

In addition, the binder supply unit 171A and the color material supply unit 3A are coupled in this order from the upstream side to the pipe 172A downstream of the on-off valve 7A. Therefore, the mixture M7A obtained by mixing the subdivided bodies M6A, the binder P1, and the color material CM1 is generated downstream of the on-off valve 7A, and the mixture M7A is supplied to the first material supply unit 18A.

In addition, the binder supply unit 171B and the color material supply unit 3B are coupled in this order from the upstream side to the pipe 172B downstream of the on-off valve 7B. Therefore, the mixture M7B obtained by mixing the subdivided bodies M6B, the binder P2, and the color material CM2 is generated downstream of the on-off valve 7B, and the mixture M7B is supplied to the second material supply unit 18B.

In addition, the binder supply unit 171C and the color material supply unit 3C are coupled in this order from the upstream side to the pipe 172C downstream of the on-off valve 7C. Therefore, the mixture M7C obtained by mixing the subdivided bodies M6C, the binder P3, and the color material CM3 is generated downstream of the on-off valve 7C, and the mixture M7C is supplied to the third material supply unit 18C.

According to the sheet manufacturing apparatus 100B, the second web M8 as the laminate obtained by laminating the layer of mixture M7A, the layer of mixture M7B and the layer of mixture M7C in this order on the mesh belt 191. Accordingly, the sheet S having the three-layer configuration is obtained by the forming unit 20.

In addition, in the sheet manufacturing apparatus 100B, the first defibration unit 13A, the second defibration unit 13B, and the third defibration unit 13C are provided and are individually coupled to the first material supply unit 18A, the second material supply unit 18B, and the third material supply unit 18C, respectively. Therefore, defibration forces or periods of defibration time of the first defibration unit 13A, the second defibration unit 13B, and the third defibration unit 13C are adjusted, and thereby it is possible to supply the subdivided bodies M6A, the subdivided bodies M6B, and the subdivided bodies M6C, which have different lengths of fiber from each other, individually to the first material supply unit 18A, the second material supply unit 18B, and the third material supply unit 18C, respectively, for example.

Therefore, it is possible to obtain the second web M8 as illustrated in FIG. 12, for example. In the second web M8, an average length of fibers of the mixture M7A is longer than that of fibers of the mixture M7B and that of fibers of the mixture M7C, and the mixture M7A plays a role of increasing strength of the entire sheet S after the forming. In addition, an average length of fibers of the mixture M7C is shorter than that of fibers of the mixture M7A and that of fibers of the mixture M7B, and the mixture M7C exhibits a good function as an ink receiving layer after the forming. In other words, since the average length is short, ink bleeding is prevented, and thus it is possible to obtain printed matter having high resolution.

In addition, in the second web M8, since the layer of the mixture M7A is the thickest, and the layer of mixture M7C is thicker than the layer of mixture M7B, the layer of mixture M7A can exhibit high strength after the forming. For example, the thickness of the layer of mixture M7A can be about 0.1 mm or larger and 5 mm or smaller. In addition, the thickness of the layer of mixture M7B can be about 0.01 mm or larger and 0.1 mm or smaller. In addition, the thickness of the layer of mixture M7C can be about 0.01 mm or larger and 0.1 mm or smaller.

In addition, a supply amount the binder P2 of the layer of mixture M7B which is the middle layer after the forming is larger than that of the mixture M7A and the mixture M7C, and thereby it is possible to prevent the ink from infiltrating in a thickness direction of the sheet S. In other words, the layer of mixture M7*b* functions as an ink infiltration preventive layer after the forming.

As described above, the sheet manufacturing apparatus 100B includes the first defibration unit 13A that defibrates the raw material M1 (used paper) so as to generate the subdivided bodies M6A (first defibrated substance), the second defibration unit 13B that defibrates the raw material M1 (used paper) so as to generate the subdivided bodies M6B (second defibrated substance), and the third defibration unit 13C that defibrates the raw material M1 (used paper) so as to generate the subdivided bodies M6C (third defibrated substance). Consequently, as described above, it is possible to generate the subdivided bodies M6A, the subdivided bodies M6B, and the subdivided bodies M6C, which have different average lengths of fiber from each other, depending on a use. As a result, it is possible to impart various functions to the sheet S.

Any one of the first defibration unit 13A to the third defibration unit 13C may be omitted such that a virgin fiber supply unit that supplies virgin fibers having a relatively long fiber length is provided. In this case, the first defibration unit 13A and the third defibration unit 13C may both be configured to be replaced with the virgin fiber supply units. Consequently, in the sheet S to be obtained, the front surface and the back surface are layers of virgin paper formed of the virgin fibers, and the middle layer is a layer of recycled paper. Accordingly, it is possible to manufacture paper approximate to the virgin paper, by using the recycled paper.

In addition, the binder supply unit may be coupled to the virgin fiber supply unit, and the binder supply unit may be coupled to the downstream of the virgin fiber supply (for example, the material supply unit).

In addition, it is possible to change an amount of subdivided bodies (defibrated substance) or a supply amount of the virgin fibers in the sheet S depending on a use of the sheet S. In other words, it is possible to change a used paper using rate depending on a use of the sheet S. For example, in a case where the sheet S is used as a postcard, the used paper using rate is preferably 50% or higher.

In addition, an impregnation suppressing layer (stop layer) that suppresses impregnation of ink may be provided between the layer of virgin paper and the layer of recycled paper.

Fourth Embodiment

Figure 13:
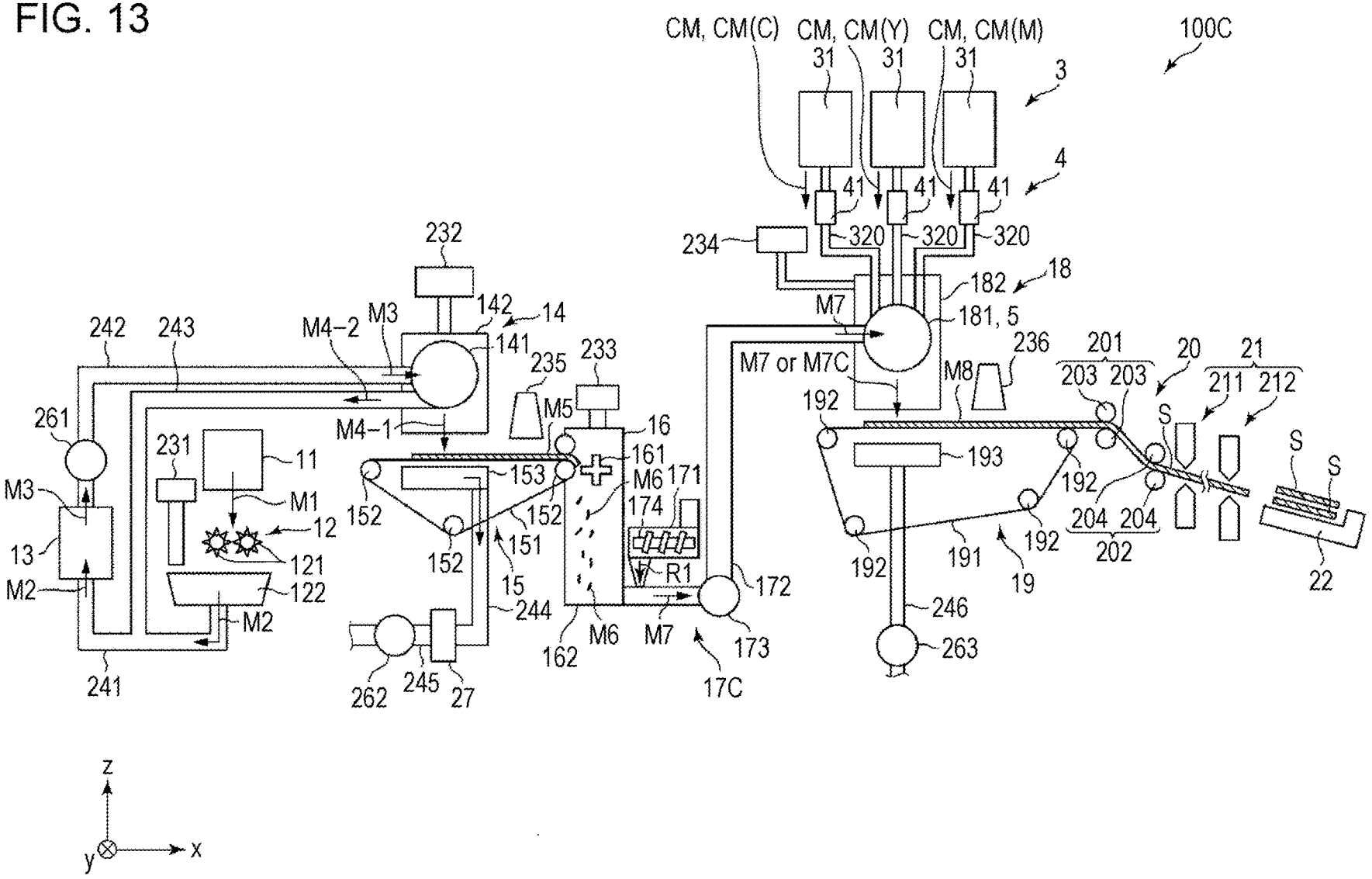
FIG. 13 is a schematic side view illustrating a sheet manufacturing apparatus of a fourth embodiment to which a fibrous raw material recycling apparatus is applied.
Figure 14:
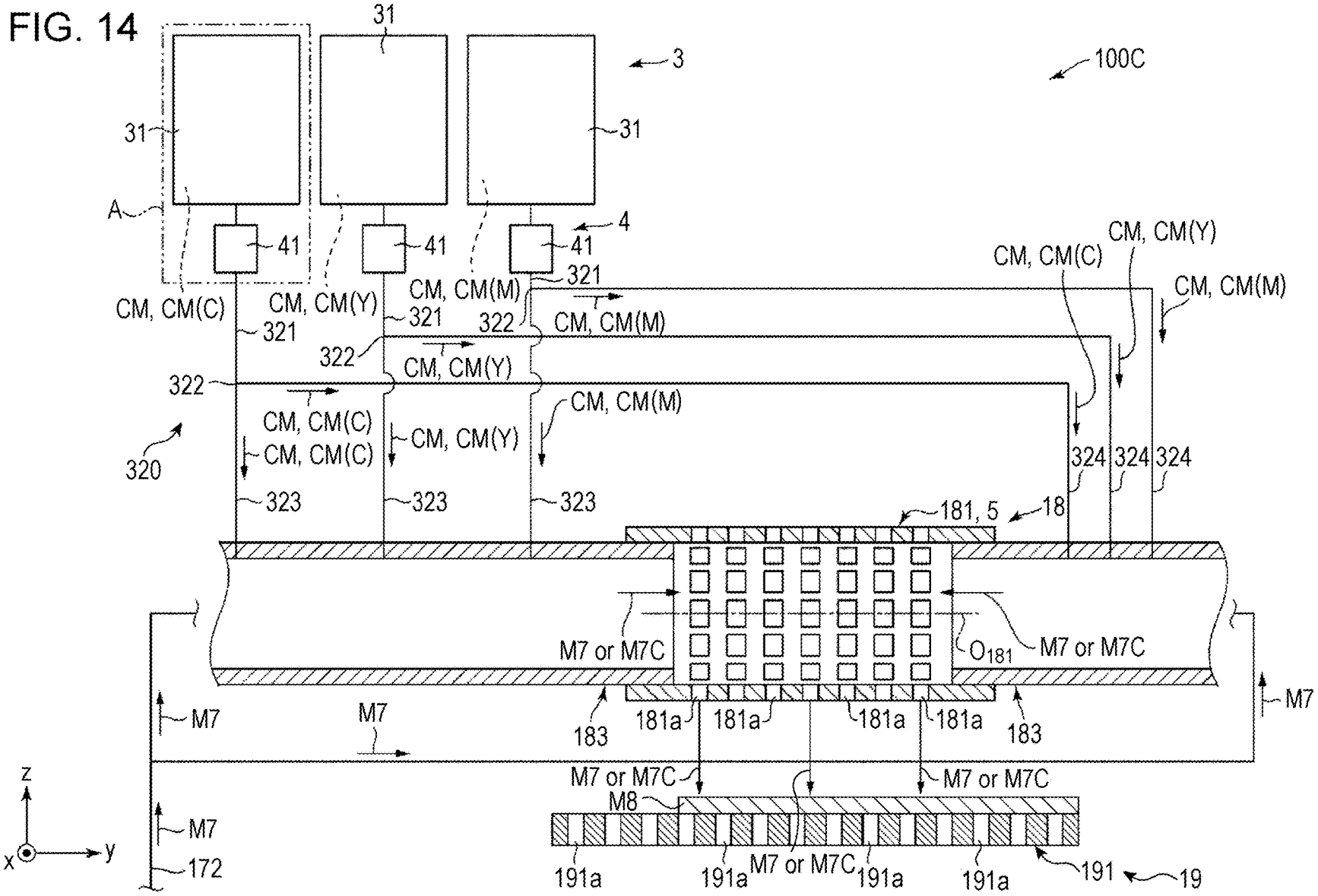
FIG. 14 is a vertical sectional view illustrating a dispersion unit and a periphery thereof included in the sheet manufacturing apparatus illustrated in FIG. 13.
Figure 15:
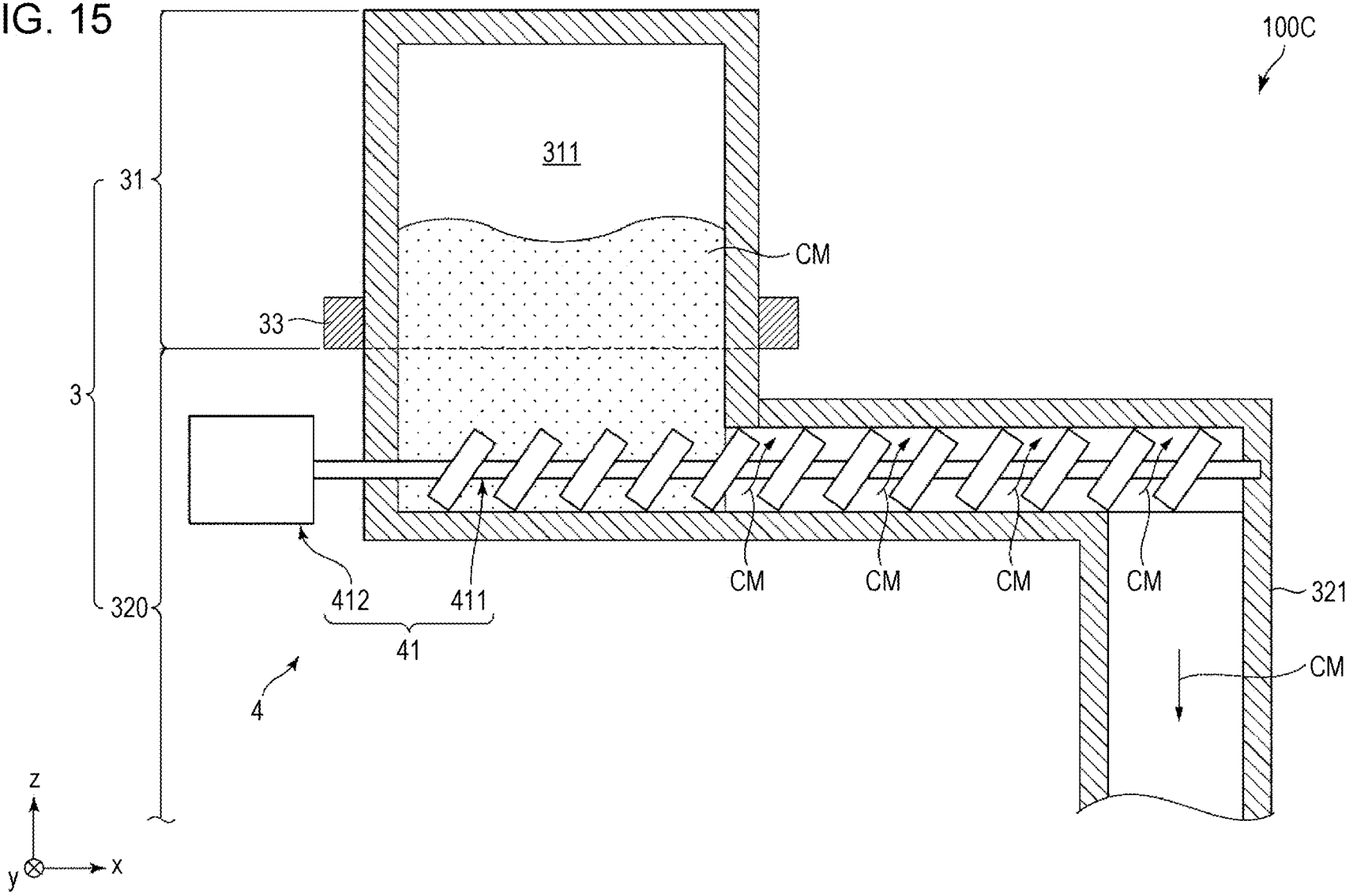
FIG. 15 is a vertical sectional view of a region XV surrounded by a two-dot chain line in FIG. 14.
Figure 16:
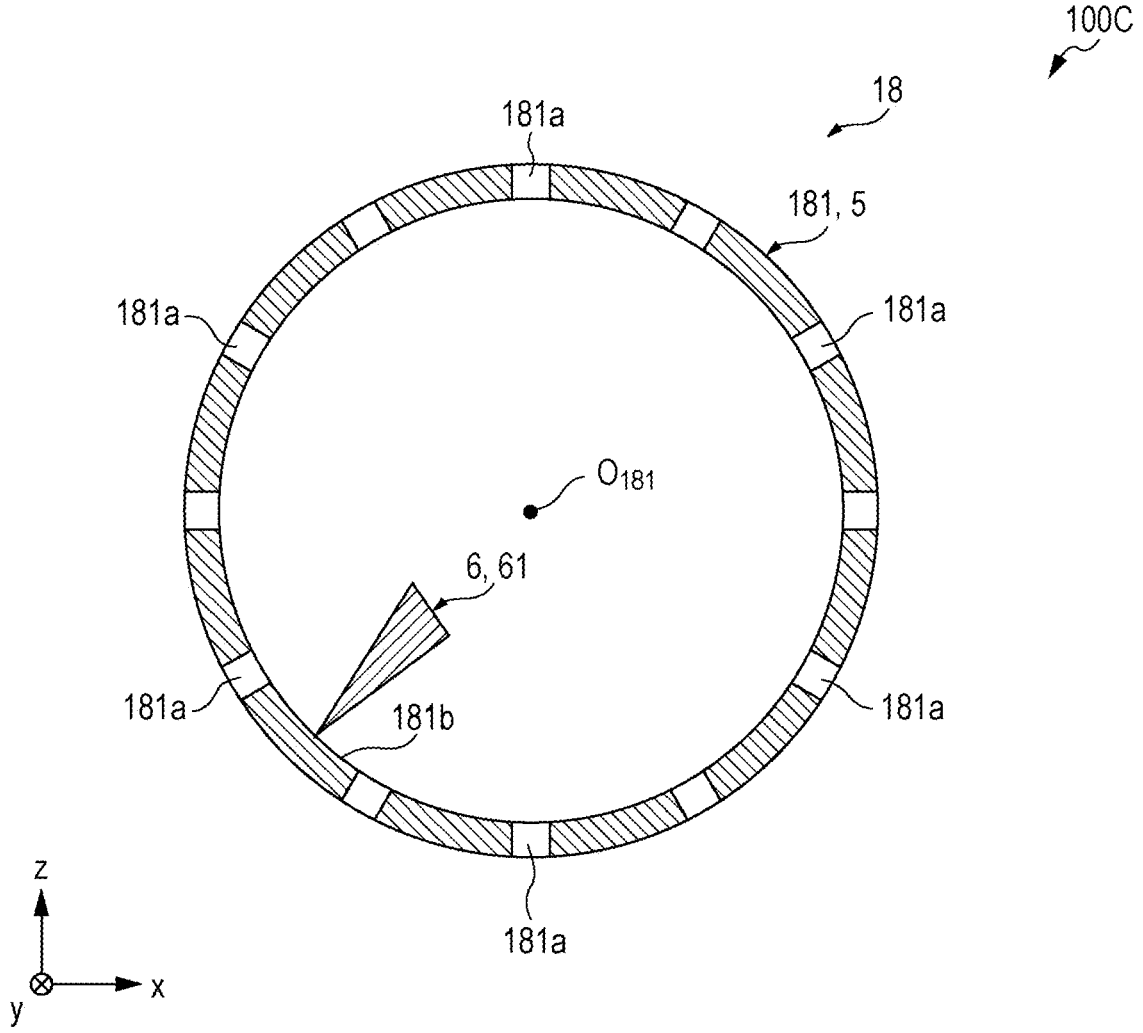
FIG. 16 is a vertical sectional view illustrating the dispersion unit included in the sheet manufacturing apparatus illustrated in FIG. 13.
Figure 17:
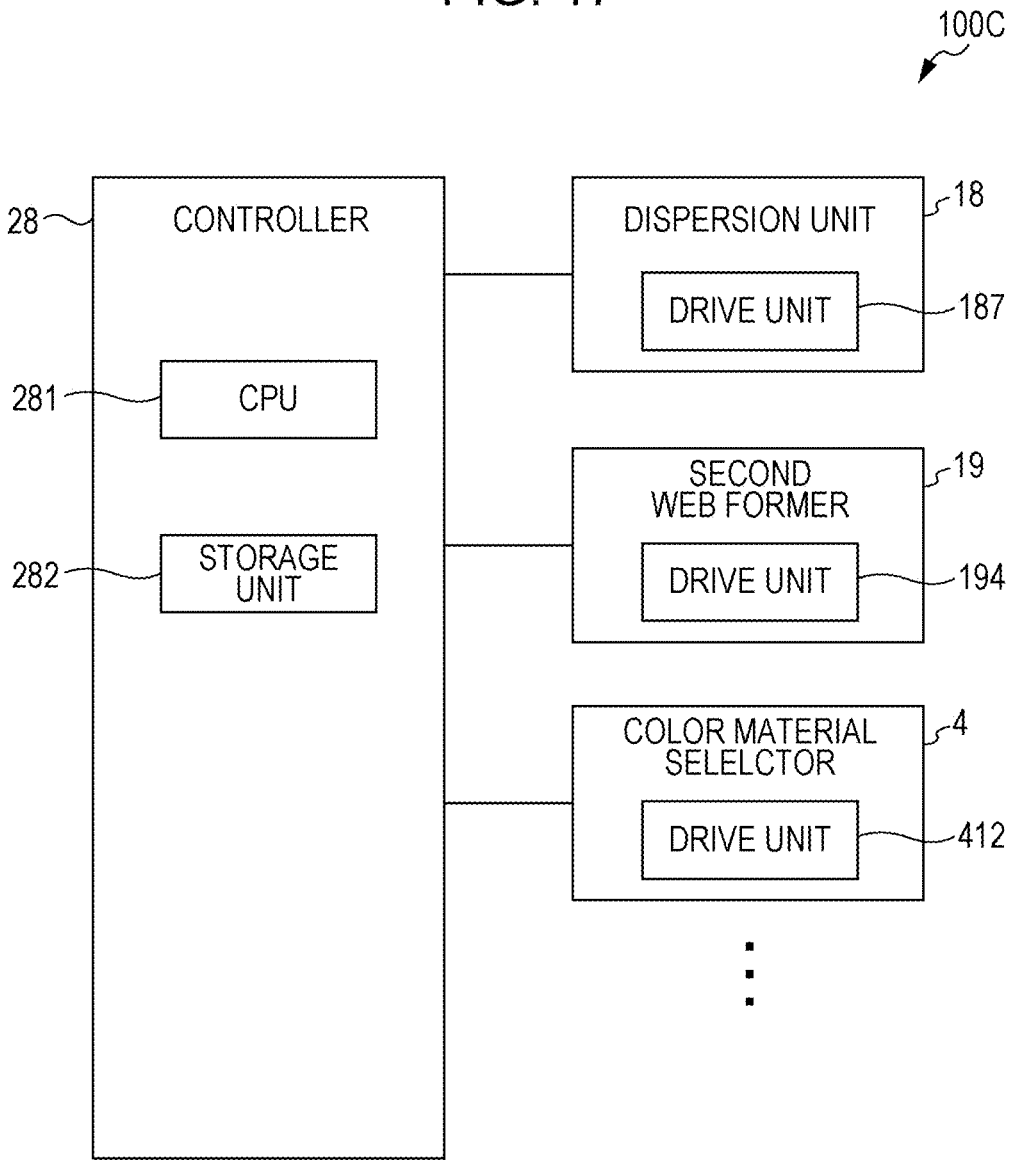
FIG. 17 is a block diagram of main components included in the sheet manufacturing apparatus illustrated in FIG. 13.

FIG. 13 is a schematic side view illustrating a fourth embodiment in a case where a fibrous raw material recycling apparatus is applied to the sheet manufacturing apparatus. FIG. 14 is a vertical sectional view illustrating a dispersion unit and a periphery thereof included in the sheet manufacturing apparatus illustrated in FIG. 13. FIG. 15 is a vertical sectional view of a region XV surrounded by a two-dot chain line in FIG. 14. FIG. 16 is a vertical sectional view illustrating the dispersion unit included in the sheet manufacturing apparatus illustrated in FIG. 13. FIG. 17 is a block diagram of main components included in the sheet manufacturing apparatus illustrated in FIG. 13.

Hereinafter, the fourth embodiment of the present disclosure will be described with reference to the drawings by focusing on differences from the embodiments described above, the same names and reference signs are assigned to the same items, and the description thereof is omitted.

As illustrated in FIG. 13, the sheet manufacturing apparatus 100C as the fibrous raw material recycling apparatus is the apparatus that manufactures the sheet S. The sheet manufacturing apparatus 100 includes: a dispersion unit 18 that has at least one (in the embodiment, one) cylindrical drum section (drum) 181 inside which a defibrated substance-containing material (mixture M7) containing the defibrated substance M3 obtained by defibrating paper as the raw material M1 is introduced and which disperses and loosens the material in the gas atmosphere; color material supply units 3 that are capable of supplying a plurality of different color materials CM inside the drum section (drum) 181; and a color material selector 4 that is capable of selecting supply of the color materials CM from the color material supply units 3 to the inside of the drum section (drum) 181.

In the sheet manufacturing apparatus 100C, it is possible to select a desired color material CM (for example, as the "color material CM(C)") by the color material selector 4. In this manner, it is possible to supply the selected color material CM (C) individually to a target part (for example, the drum section 181) in a state in which mixing with the color materials CM (the color material CM(Y) or the color material CM(M)) having the other colors is reduced.

In addition, after the color material CM(C), even in a case where selection is changed to the color material CM(Y), for example, instead of the color material CM(C), it is possible to supply the color material CM(Y) to the drum section 181 in a state in which the mixing with the color material CM(C) or the color material CM(M) is prevented.

As described above, in the sheet manufacturing apparatus 100C, it is possible to reduce a color mixture (in the case described above, a color mixture of the color material CM(Y) after selection with the color material CM(C) or the color material CM(M)) that is not desired by the user when selection of the color material CM is changed.

In addition, in a case where the color mixture that is not desired by the user occurs, there is a concern that the sheet S will be useless (wasted). However, the sheet manufacturing apparatus 100C employs a configuration in which the color mixture that is not desired by the user is prevented from occurring as described above, and thereby it is possible to reduce an occurrence of a case where the sheet S is useless (wasted).

As illustrated in FIG. 13, the sheet manufacturing apparatus 100C includes the raw material supply unit 11, the rough crushing unit 12, the defibration unit 13, the sorting unit 14, the first web former 15, the subdivision unit 16, a mixer 17C, the dispersion unit 18, the second web former 19, the forming unit 20, the cutter 21, the stock unit 22, the collection unit 27, the color material supply unit 3, and the color material selector 4. In addition, the sheet manufacturing apparatus 100C includes the humidifying unit 231, the humidifying unit 232, the humidifying unit 233, the humidifying unit 234, the humidifying unit 235, and a humidifying unit 236. Additionally, the sheet manufacturing apparatus 100C includes the blower 261, the blower 262, and the blower 263.

In addition, as illustrated in FIG. 17, the units included in the sheet manufacturing apparatus 100C, for example, the drive unit 187 of the dispersion unit 18, the drive unit 194 of the second web former 19, the drive unit 412 of the color material selector 4, and the like are electrically coupled to the controller 28. In this manner, operations of the units are controlled by the controller 28. The controller 28 includes the central processing unit (CPU) 281 and the storage unit 282. For example, the CPU 281 is capable of performing various types of determination, issuing various types of instructions, or the like. For example, the storage unit 282 stores various types of programs such as programs used until the sheet S is manufactured.

The configuration, the coupling to the sheet manufacturing apparatus 100C, and an installation state of the controller 28 are the same as those of the embodiments described above, and thus the detailed description thereof is omitted.

In addition, a manufacturing step and an order of steps of the sheet manufacturing apparatus 100C are the same as those of the sheet manufacturing apparatus of the embodiments described above, and thus the detailed description thereof is omitted.

Hereinafter configurations of the units will be described.

In the sheet manufacturing apparatus 100C, the raw material supply unit 11, the rough crushing unit 12, the defibration unit 13, the sorting unit 14, the first web former 15, the subdivision unit 16, the forming unit 20, the cutter 21, the stock unit 22, and the collection unit 27, are the same as those in the sheet manufacturing apparatus 100 of the embodiments described above. In addition, the humidifying unit 231, the humidifying unit 232, the humidifying unit 233, the humidifying unit 234, the humidifying unit 235, the blower 261, the blower 262, and the blower 263 are the same as those of the sheet manufacturing apparatus 100. Therefore, the detailed description thereof is omitted.

As illustrated in FIG. 13, in the sheet manufacturing apparatus 100C, the mixer 17C is disposed downstream of the subdivision unit 16. The mixer 17C executes the mixing step of mixing the subdivided bodies M6 and resin R1. The mixer 17C includes a resin supply unit 171, a tube (first flow channel) 172, and the blower 173.

The pipe 172 is a flow channel which couples the subdivision unit 16 and the dispersion unit 18 to each other and through which the mixture M7 of the subdivided bodies M6 and the resin R1 passes.

The resin supply unit 171 is coupled to the pipe 172 at a position on the pipe. The resin supply unit 171 includes a screw feeder 174. The screw feeder 174 is rotatably driven, and thereby it is possible to supply the resin R1 as powder or particles to the pipe 172. The resin R1 supplied to the pipe 172 is mixed with the subdivided bodies M6 such that a mixture M7 is obtained.

The resin R1 causes the fibers to be bound in the subsequent step, and it is possible to use thermoplastic resin, hardening resin, or the like, for example, and it is preferable to use the thermoplastic resin. Examples of thermoplastic resin include polyolefin or modified polyolefin such as AS resin, ABS resin, polyethylene, polypropylene, or ethylene-vinyl acetate copolymer (EVA); acrylic resin such as polymethyl methacrylate; polyester such as polyvinyl chloride, polystyrene, polyethylene terephthalate, or polybutylene terephthalate; polyamide (nylon) such as nylon 6, nylon 46, nylon 66, nylon 610, nylon 612, nylon 11, nylon 12, nylon 6-12, or nylon 6-66; liquid crystal polymer such as polyphenylene ether, polyacetal, polyether, polyphenylene oxide, polyether ether ketone, polycarbonate, polyphenylene sulfide, thermoplastic polyimide, polyether imide, or aromatic polyester; and various types of thermoplastic elastomer such as styrene-based elastomer, polyolefin-based elastomer, polyvinyl chlorine-based elastomer, polyurethane-based elastomer, polyester-based elastomer, polyamide-based elastomer, polybutadiene-based elastomer, trans-polyisoprene-based elastomer, fluororubber-based elastomer, or chlorinated polyethylene-based elastomer, and the resins can be used individually or as a combination of two or more resins thereof. Preferably, polyester or a substance containing polyester is used as thermoplastic resin.

Examples of substances that are supplied from the resin supply unit 171 include a clumping inhibitor for inhibiting the fibers from clumping or the resin R1 from clumping, a flame retardant for retarding progression of burning of fibers or the like, or a paper strengthening agent for strengthening paper strength of the sheet S, in addition to the resin R1. Otherwise, a substance obtained by mixing (compounding) the agents described above with the resin R1 in advance may be supplied from the resin supply unit 171.

In addition, the blower 173 is installed downstream of the resin supply unit 171 at a position on the pipe 172. The rotation unit such as the vane provided in the blower 173 is operated, and thereby the subdivided bodies M6 and the resin R1 are mixed with each other. In addition, the blower 173 is capable of generating an air current toward the dispersion unit 18. The air current enables the subdivided bodies M6 and the resin R1 to be agitated in the pipe 172.

Consequently, the mixture M7 can flow to the dispersion unit 18 in a state in which the subdivided bodies M6 and the resin R1 are uniformly dispersed. In addition, the subdivided bodies M6 in the mixture M7 are loosened in a process of passing through the pipe 172 so as to have a finer fiber shape.

In addition, the sheet manufacturing apparatus 100C has a configuration in which the resin R1 is supplied from the resin supply unit 171. However, the present disclosure is not limited thereto. For example, the resin R1 is stored in the storage section 31 to be described below in advance, and thus the resin may pass along with the color material CM through the flow channel (second flow channel) 32 so as to be supplied to the drum section 181. In addition, in a case where the supply of the resin from the resin supply unit 171 is stopped, resin contained in the color material CM may be used instead of the resin R1.

The dispersion unit 18 executes a step of accumulating the mixture M7 on the mesh belt 191 (separation belt). The dispersion unit 18 has the drum section 181 and the housing section 182 that houses the drum section 181.

As illustrated in FIG. 14, the drum section 181 is a sieve that is configured of a net body having a circular cylinder shape and rotates around the center axis $O_{181}$ thereof. The mixture M7 by the mixer 17C flows into the drum section 181. In this manner, the drum section 181 rotates, and thereby a fiber or the like, which is smaller than the mesh opening of the net, of the mixture M7, can pass through the drum section 181. In this case, the mixture M7 is loosened.

Since the drum section 181 is the same as that of the embodiments described above, the description thereof is omitted.

In this manner, the mixture M7 loosened in the drum section 181 falls down while being dispersed in the gas atmosphere toward the second web former 19 that is positioned below the drum section 181. The second web former 19 executes the second web forming step of forming the second web M8 from the mixture M7. The second web former 19 includes the mesh belt 191 (separation belt), a stretching roller 192, and a suction unit (suction mechanism) 193.

The mesh belt 191 is an endless belt and accumulates the mixture M7. The mesh belt 191 loops around the four stretching rollers 192. In this manner, the stretching rollers 192 are rotatably driven, and thereby the mixture M7 on the mesh belt 191 is transported downstream.

In addition, almost all of the mixture M7 on the mesh belt 191 have a size equal to or larger than a mesh opening of the mesh belt 191. Consequently, the mixture M7 is restricted from passing through the mesh belt 191, and thereby it is possible to accumulate the mixture on the mesh belt 191. In addition, the mixture M7 is transported downstream along with the mesh belt 191 while being accumulated on the mesh belt 191 and, thus, are formed into the layer-shaped second web M8.

In addition, the stretching roller 192 is interconnected with the drive unit 194 having a drive source such as at least one motor, a transmission, or the like, and thus an operation of the drive unit 194 enables the stretching roller to rotate at a predetermined rotation speed. The operation of the drive unit 194 is controlled by the controller 28 (refer to FIG. 17), and it is possible to change (set, in multiple levels) the rotation speed of the stretching roller 192, for example.

The suction unit 193 suctions air from below the mesh belt 191. Consequently, it is possible to suction the mixture M7 on the mesh belt 191, and thereby it is possible to accumulate the mixture M7 on the mesh belt 191.

A pipe (flow channel) 246 is coupled to the suction unit 193. In addition, the blower 263 is installed at a position on the pipe 246. An operation of the blower 263 can generate a suction force by the suction unit 193.

The housing section 182 is coupled to the humidifying unit 234. The humidifying unit 234 is configured of the same vaporization-type humidifier as the humidifying unit 231. Consequently, the humidified air is supplied into the housing section 182. It is possible to humidify the inside of the housing section 182 with the humidified air, and thereby it is possible to suppress attachment of the mixture M7 to the inner wall of the housing section 182 due to the electrostatic force.

The humidifying unit 236 is disposed downstream of the dispersion unit 18. The humidifying unit 236 is configured of the same ultrasound-type humidifier as the humidifying unit 235. Consequently, it is possible to supply moisture to the second web M8, and thereby a moisture amount of the second web M8 is adjusted. Adjustment of the moisture amount makes it possible to suppress attachment of the second web M8 to the mesh belt 191 due to the electrostatic force. Consequently, the second web M8 is easily peeled from the mesh belt 191 at a position at which the mesh belt 191 is bent by the stretching roller 192.

For example, a moisture amount (total moisture amount) from the humidifying units 231 to 236 is preferably 0.5 parts by mass or larger and 20 parts by mass or smaller in terms of 100 parts by mass of a material before humidifying.

The forming unit 20 is disposed downstream of the second web former 19. The forming unit 20 executes the sheet forming step of forming the sheet S from the second web M8. The forming unit 20 includes the pressurizing unit 201 and the heating unit 202.

Since the forming unit 20 is the same as that of the embodiments described above, the description thereof is omitted. Also in the embodiment, the resin R1 is melted in the second web M8 through heating and pressurizing by the forming unit 20 such that fibers are bound to each other via the melted resin R1. Consequently, the sheet S is formed.

The cutter 21 is disposed downstream of the forming unit 20. The cutter 21 executes the cutting step of cutting the sheet S. The cutter 21 includes the first cutter 211 and the second cutter 212. Since the cutter 21 is the same as that of the embodiments described above, the description thereof is omitted. Also in the embodiment, the sheet S having a desired size is obtained by the cutter 21. In this manner, the sheet S is transported further downstream and is accumulated in the stock unit 22.

However, the sheet manufacturing apparatus 100C is configured to be capable of manufacturing the sheet S having a color, that is, a color sheet. Hereinafter the configuration and an effect will be described.

As described above, the dispersion unit 18 executes a process of loosening the mixture M7 that is obtained by mixing the subdivided bodies M6 (defibrated substance M3) and the resin R1. Consequently, the mixture M7 falls down uniformly in the gas atmosphere, that is, is unraveled from a state in which the mixture is intertwined and clumped, while being dispersed such that the mixture is accumulated on the mesh belt 191 of the second web former 19.

As illustrated in FIG. 14, the second web former 19 (accumulating unit) is provided on the lower side (outer circumferential side) of the drum section 181 provided in the dispersion unit 18. The second web former 19 accumulates the mixture M7 that has passed through the opening portion 181*a* of the drum section 181. In this manner, the mixture M7 as the accumulated substance accumulated on the second web former 19 becomes the second web M8.

As described above, the second web former 19 includes the mesh belt 191 on which the second web M8 is accumulated and which transports the second web M8. The mesh belt 191 is provided with a plurality of through-hole 191*a* formed to penetrate in a thickness direction thereof. A shape of the through-hole 191*a* in a plan view is not particularly limited. For example, the shape is preferably a circular shape, an elliptical shape, an oval shape, a polygonal shape, or the like. In addition, a size of the through-hole 191*a* in a plan view is not particularly limited. For example, the maximum length of the opening of the through-hole 191*a* is preferably 0.02 mm or larger and 2 mm or smaller, and preferably 0.05 mm or larger and 1 mm or smaller. In addition, a forming method of the through-hole 191*a* is not particularly limited. For example, it is possible to use a method of machining such as punching. In addition, of the machining, it is possible to use a method of laser machining or etching machining. In addition, it is possible to use a resin net, a metal net, and expanded metal as the mesh belt 191.

As illustrated in FIGS. 13 and 14, the color material supply unit 3 is disposed upstream of the drum section 181 of the dispersion unit 18. The color material supply unit 3 executes the color material supplying step of supplying the color material CM selected by the color material selector 4 to the drum section 181 of the dispersion unit 18.

The color materials CM include a plurality of different color materials, and in the embodiment, examples thereof include three types of color materials CM having at least different colors. The three types of color materials CM are pigments having chromatic colors, and examples thereof cyan (C), yellow (Y), and magenta (M). Hereinafter, the color material CM of cyan is referred to as the "color material CM(C)", the color material CM of yellow is referred to as the "color material CM(Y)", and the color material CM of magenta is referred to as the "color material CM(M)", in some cases. The color of the color material CM is not limited to cyan, yellow, and magenta.

As illustrated in FIG. 14, the color material supply unit 3 includes a plurality of storage sections 31 that store individually the color material CM(C), the color material CM(Y), and the color material CM(M), respectively, and a flow channel 320 coupled to the storage section 31. Since the storage sections 31 and the flow channels 320 have the same configuration except that the color material CM that is supplied to the drum section 181 is different from each other, hereinafter, one storage section 31 and the flow channel 320 coupled to the storage section 31 are representatively described.

As illustrated in FIG. 15, the storage section 31 is configured of a hollow body having the storage space 311 for storing the color material CM inside. The storage section 31 is detachably mounted on the mounting unit 33 provided in the sheet manufacturing apparatus 100C. In this manner, in the mounting state, the storage space 311 of the storage section 31 communicates with the flow channel 320. Consequently, the color material CM can flow into the flow channel 320.

It is preferable that the storage section 31 be configured of a cartridge. Consequently, in a case where the storage section 31 is empty, that is, the color material CM is used up, is possible to replace with the storage section 31 with a new storage section 31 in a case where the storage section 31 is empty, that is, the color material CM1 is used up. In addition, in the sheet manufacturing apparatus 100C, a remaining amount of the color material CM in the storage section 31 is detected by a remaining amount detector (not illustrated).

As illustrated in FIG. 14, the flow channel 320 is coupled to the storage section 31 at the upstream on the flow channel and is coupled to the inflow port 183 of the dispersion unit 18 at the downstream. Consequently, the color material CM can pass individually through the flow channel 320 from the storage section 31 to the inflow port 183, that is, in a state in which mixing of the color material CM with the other color materials is prevented.

For example, the flow channel 320 is configured of a pipe 321. The pipe 321 diverges into two pipes which are a diverging pipe 323 and a diverging pipe 324 via a diverging portion 322. In this manner, the diverging pipe 323 is coupled to one inflow port 183 of the two inflow ports 183, and the diverging pipe 324 is coupled to the other inflow port 183. Consequently, the storage section 31 and the inflow ports 183 communicate with each other via the flow channel 320. In this manner, the mixture M7 and the color material CM can be joined to each other in the drum section 181, and thereby the mixture M7C containing the mixture M7 and the color material CM is generated.

The color material selector 4 selectively supplies the color materials CM from the color material supply unit 3 to the drum section 181.

As described above, the color material supply unit 3 includes the flow channel 320 through which the color materials CM having different colors from each other individually pass. As illustrated in FIG. 14, the color material selector 4 includes a switching unit 41 that is provided on the flow channels 320 and switches between passing of the color materials CM and stop of the passing. Consequently, the sheet manufacturing apparatus 100C is capable of taking a color material supply state in which the color materials CM are supplied and a supply stop state in which the supply of the color materials CM is stopped. Consequently, the sheet S having the selected color material CM is obtained in the color material supply state, and the sheet S, from which the color material CM is omitted, is obtained in the supply stop state.

As illustrated in FIG. 15, the switching unit 41 is a screw feeder and includes the screw 411 inserted concentrically into the flow channel 320 (pipe 321) and a drive unit 412 that rotatably drives the screw 411.

The screw 411 rotates, and thereby the color material CM can be extracted from the storage section 31 and can be extruded downstream as it is. Consequently, the color material CM can pass through the flow channel 320 so as to reach the drum section 181. In addition, the rotation of the screw 411 is stopped, and thereby it is also possible to stop extrusion of the color material CM.

For example, the drive unit 412 is configured of a motor or the like. In addition, as illustrated in FIG. 17, the drive unit 412 is electrically coupled to the controller 28. Consequently, an operation of the drive unit 412 is controlled by the controller 28, and thereby it is possible to change a rotation speed of the screw 411. It is possible to adjust a supply amount of the supply rate of the color material CM depending on a level of the rotation speed of the screw 411, and thereby the sheet S having a desired shade of a color is obtained, for example. For example, operation information of the drive unit 412 is input and stored to the controller 28 in advance via an input unit such as a keyboard or a touch panel (not illustrated).

It is possible to selectively supply the desired color material CM by the color material selector 4 having such a configuration. Consequently, it is possible to individually supply any one color material CM of the color material CM(C), the color material CM(Y), or the color material CM(M) to the drum section 181, or it is possible to combine at least two color materials CM of the color material CM(C), the color material CM(Y), and the color material CM(M) so as to supply the combined color material to the drum section 181. In addition, in a case where the color materials CM are combined to each other, it is possible to adjust a mixing ratio of the color materials CM by changing the rotating speed of the screw 411.

The switching unit 41 is not limited to the screw feeder and may include a belt transporting mechanism, for example.

As illustrated in FIG. 14, the sheet manufacturing apparatus 100C includes a mixer 5 that mixes the color materials CM having colors different from each other which are selected by the color material selector 4. In the embodiment, the drum section (drum) 181 also serves as the mixer 5.

In a case where the plurality of color materials CM are selected by the color material selector 4, the mixture M7 and the color materials CM are supplied as the mixture M7C to the drum section 181, that is, the mixer 5. In this manner, the drum section 181 rotates around the center axis $O_{181}$, and thereby it is possible to uniformly mix the mixture M7 and the color materials CM in the drum section 181 while the materials are loosened.

In addition, the drum section (drum) 181 is provided with the plurality of opening portions 181*a* as discharge portions for discharging the color materials CM along with the mixture M7 (defibrated substance-containing material).

The sheet manufacturing apparatus 100C includes the second web former 19 that forms the second web M8 (web) by using the mixture M7 (defibrated substance-containing material) that is subjected to an unraveling process (loosening process) in the dispersion unit 18 and has passed through the opening portion. Specifically, the sheet manufacturing apparatus 100C includes the second web former 19 (web former) that is provided downstream of the drum section (drum) 181 and forms the second web M8 (web) with the mixture M7 (defibrated substance-containing material) and the color materials CM, that is, the mixture M7C, which are discharged via the opening portions 181*a* (discharge portion). Consequently, it is possible to manufacture the sheet S having a color obtained by mixing the colors of the color materials CM, on the basis of the second web M8, that is, a color sheet. In addition, the mixing ratio of the color materials CM is adjusted as described above, and thereby it is possible to manufacture the sheet S having rich gradation even when the same color mixture is used. In addition, in a case where any one color material CM of the color material CM(C), the color material CM(Y), or the color material CM(M) is individually supplied to the drum section 181, it is possible to manufacture the sheet S having a single color of cyan, yellow, or magenta. As described above, the sheet manufacturing apparatus 100C is capable of manufacturing the sheet S having the desired color. In addition, the sheet manufacturing apparatus 100C is also capable of manufacturing the sheet S from which the color is omitted when the supply of the color material CM is stopped.

In the sheet manufacturing apparatus 100C having the configuration described above, it is possible to select the desired color material CM (for example, as the "color material CM(C)") by the color material selector 4. In this manner, it is possible to supply the selected color material CM(C) individually to the drum section 181 (inflow port 183) in a state in which mixing with the other color materials CM (the color material CM(Y) or the color material CM(M)) having the other colors is reduced.

In addition, even in a case where selection is changed to the color material CM(Y), for example, instead of the color material CM(C), it is possible to supply the color material CM(Y) to the drum section 181 in a state in which the mixing with the color material CM(C) or the color material CM(M) is prevented.

As described above, in the sheet manufacturing apparatus 100C, it is possible to prevent a color mixture (in the case described above, the color mixture of the color material CM(Y) after selection with the color material CM(C) or the color material CM(M)) that is not desired by the user when selection of the color material CM is changed.

In addition, in a case where the color mixture that is not desired by the user occurs, there is a concern that the sheet S will be useless (wasted). However, the sheet manufacturing apparatus 100C employs a configuration in which the color mixture that is not desired by the user is prevented from occurring as described above, and thereby it is possible to reduce an occurrence of a case where the sheet S is useless (wasted).

As illustrated in FIG. 16, the sheet manufacturing apparatus 100C includes a removing unit 6 that removes a residue in the drum section (drum) 181. The removing unit 6 is extended in the y-direction and includes a plate-shaped squeegee 61 corresponding to the inner circumferential portion 181*b* of the drum section 181. The squeegee 61 maintains a position and a posture constantly regardless of the rotation of the drum section 181. The residue attached to the inner circumferential portion 181*b* of the drum section 181 is removed by the squeegee 61 when the drum section 181 rotates. In this manner, the removed residue is discharged from a discharge port (not illustrated) that passes inside the drum section 181, for example. For example, the mixture M7C or the like containing the color material CM is present as the residue.

Even when the color material CM to be selected is changed, it is possible to remove the color material CM before change from the drum section 181 by the removing unit 6 having the configuration. Consequently, it is possible to prevent the color mixture of the color material CM before the change and the color material CM after the change, which is not desired by the user, in the drum section 181. In addition, it is possible to prevent the sheet S from being useless (wasted) due to the color mixture.

Fifth Embodiment

Figure 18:
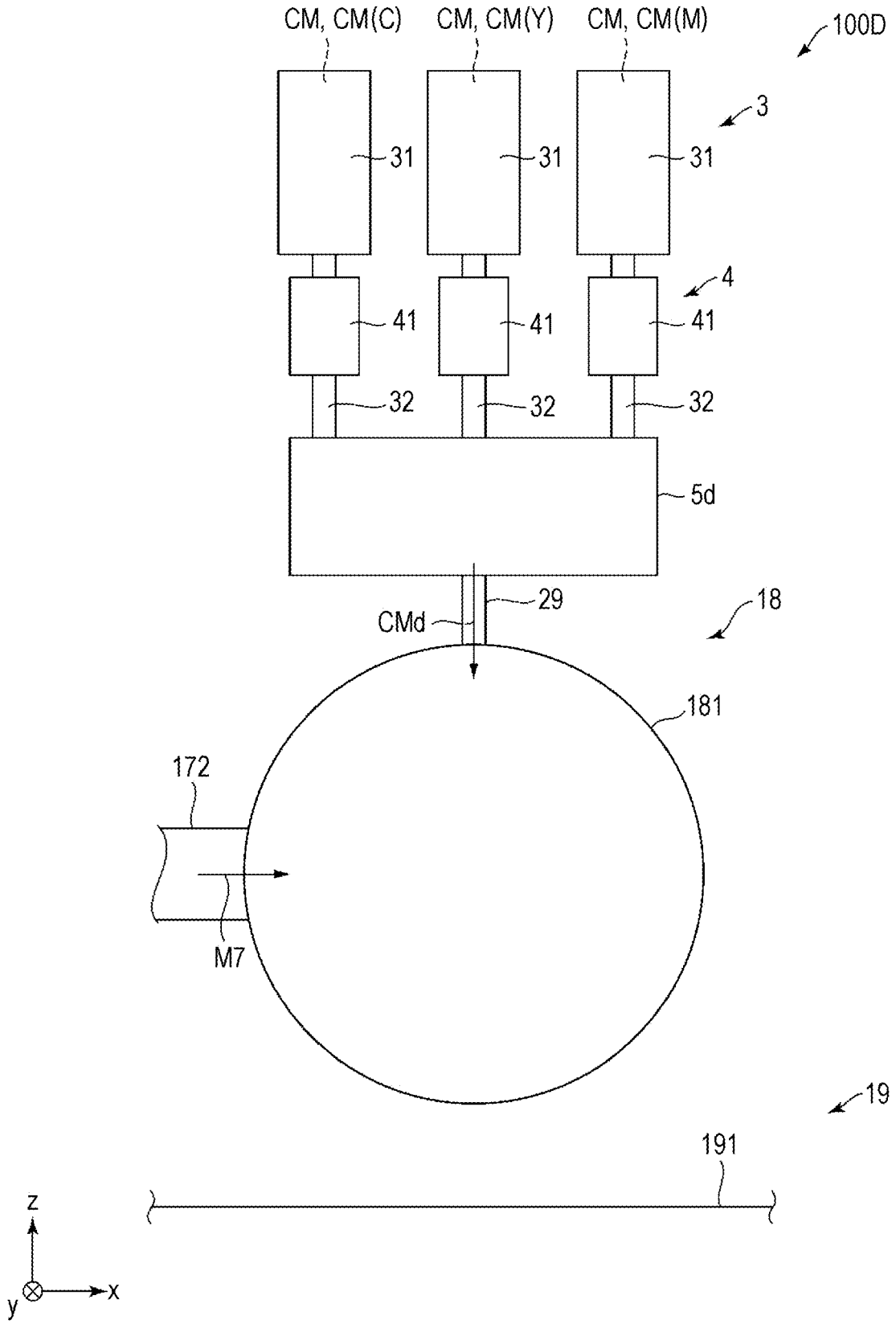
FIG. 18 is a schematic side view illustrating a dispersion unit and a periphery thereof included in a sheet manufacturing apparatus of a fifth embodiment to which the fibrous raw material recycling apparatus is applied.

FIG. 18 is a schematic side view illustrating the dispersion unit and a periphery thereof included in the sheet manufacturing apparatus (fifth embodiment) to which the fibrous raw material recycling apparatus is applied.

Hereinafter, the fifth embodiment of the sheet manufacturing apparatus, to which the fibrous raw material recycling apparatus is applied, will be described with reference to the drawings by focusing on differences from the embodiments described above, and the description of the same items is omitted.

A sheet manufacturing apparatus 100D of the embodiment is substantially the same as the fourth embodiment described above except that the mixer has a different configuration.

As illustrated in FIG. 18, a mixer 5*d* of the embodiment is disposed between the color material supply unit 3 and the drum section (drum) 181, and the color materials CM having the colors different from each other are mixed in an earlier stage than a stage in which the color materials CM are supplied to the drum section (drum) 181.

An upstream part of the mixer 5*d* is coupled to the storage sections 31 via the flow channel 32, and a downstream part thereof is coupled to the drum section 181 via a flow channel (third flow channel) 29. In addition, the mixer 5*d* is configured of a hollow body, and thus it is possible to mix the color materials CM having passed through the flow channel 32, inside the mixer. In this manner, a color material mixture CMd can pass through the flow channel 29 so as to flow into the drum section 181. The color material mixture CMd can be joined to the mixture M7 in the drum section 181 so as to be further uniformly mixed with the mixture M7 while being loosened along with the mixture M7.

Such a configuration is effective when the color materials CM are mixed with each other, and such mixing of the color materials CM is desired before the color materials CM are joined to the mixture M7.

The mixer 5*d* may be configured to pivot, similarly to the mixer 5 of the fourth embodiment. In addition, the mixer 5*d* may be configured to generate an air current therein. In the configuration, it is possible to more uniformly mix the color materials CM with the mixture M7. Consequently, it is possible to prevent color unevenness from occurring in the sheet S.

Sixth Embodiment

Figure 19:
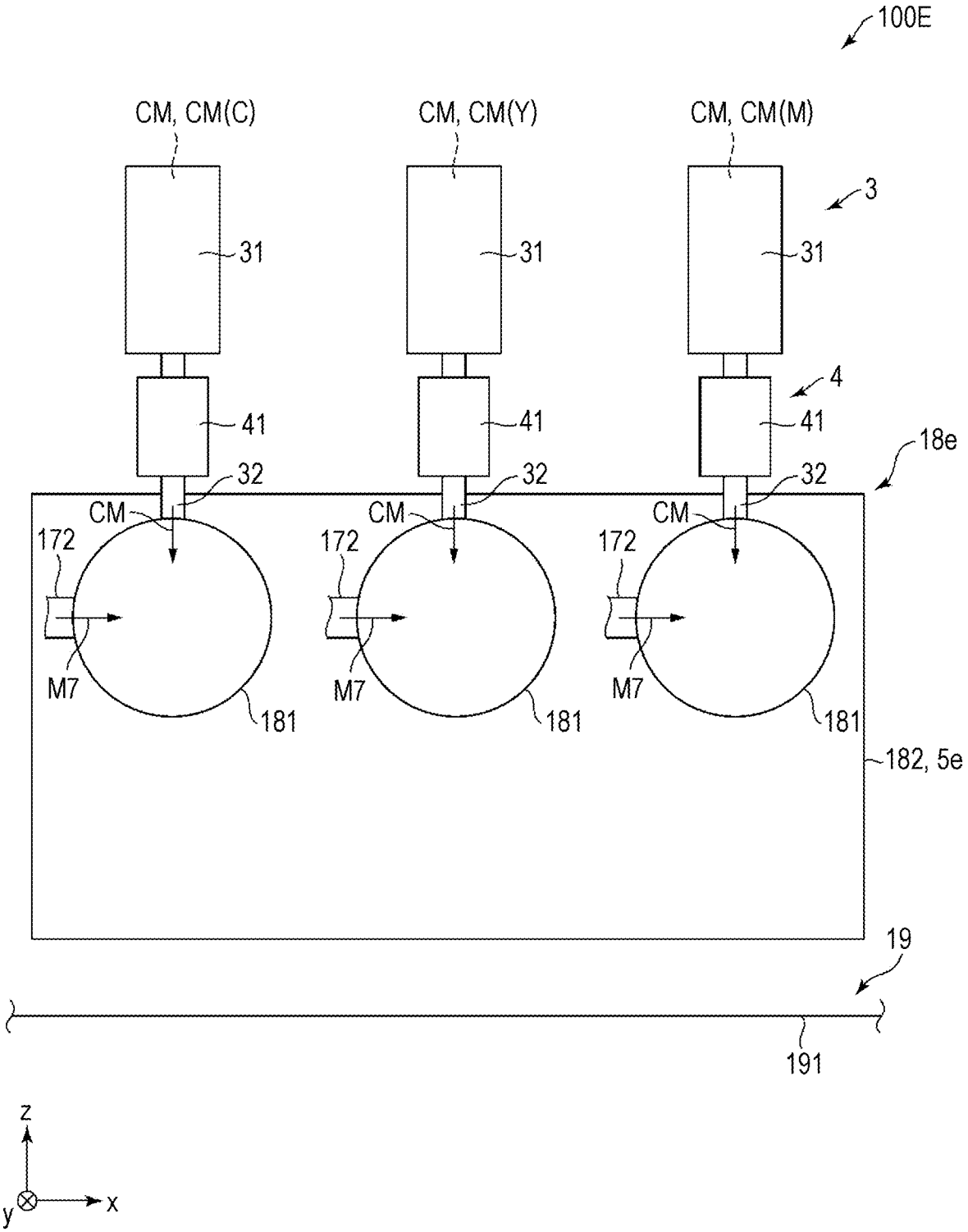
FIG. 19 is a schematic side view illustrating a dispersion unit and a periphery thereof included in a sheet manufacturing apparatus of a sixth embodiment to which the fibrous raw material recycling apparatus is applied.

FIG. 19 is a schematic side view illustrating the dispersion unit and a periphery thereof included in the sheet manufacturing apparatus (sixth embodiment) to which the fibrous raw material recycling apparatus is applied.

Hereinafter, the sixth embodiment of the sheet manufacturing apparatus, to which the fibrous raw material recycling apparatus is applied, will be described with reference to the drawings by focusing on differences from the embodiments described above, and the description of the same items is omitted.

A sheet manufacturing apparatus 100E of the embodiment is substantially the same as the fourth embodiment described above except that the mixer has a different configuration.

As illustrated in FIG. 19, in a dispersion unit 18*e* of the embodiment, the plurality of (in the embodiment, three) drum sections (drums) 181 are disposed for respective color materials CM having the colors different from each other which are supplied from the color material supply unit 3. The drum sections 181 are coupled to the storage sections 31 one by one via the flow channels 320.

In this manner, the mixer 5*e* is configured of the housing section 182 that houses the plurality of drum sections (drums) 181 collectively. The mixer 5*e*, that is, the housing section 182, is capable of mixing the color materials CM with each other when the color materials CM are discharged along with the mixture M7 (defibrated substance-containing material) from the plurality of drum sections (drums) 181, respectively.

Such a configuration is effective when the color materials CM are mixed with each other, and such mixing of the color materials CM is desired as immediately before the second web M8 is formed as possible. In addition, the plurality of drum sections 181 are disposed, and thereby the sheet manufacturing apparatus 100E can be configured to be capable of supplying the mixtures M7 having different fiber lengths (average) to the drum sections 181.

Seventh Embodiment

Figure 20:
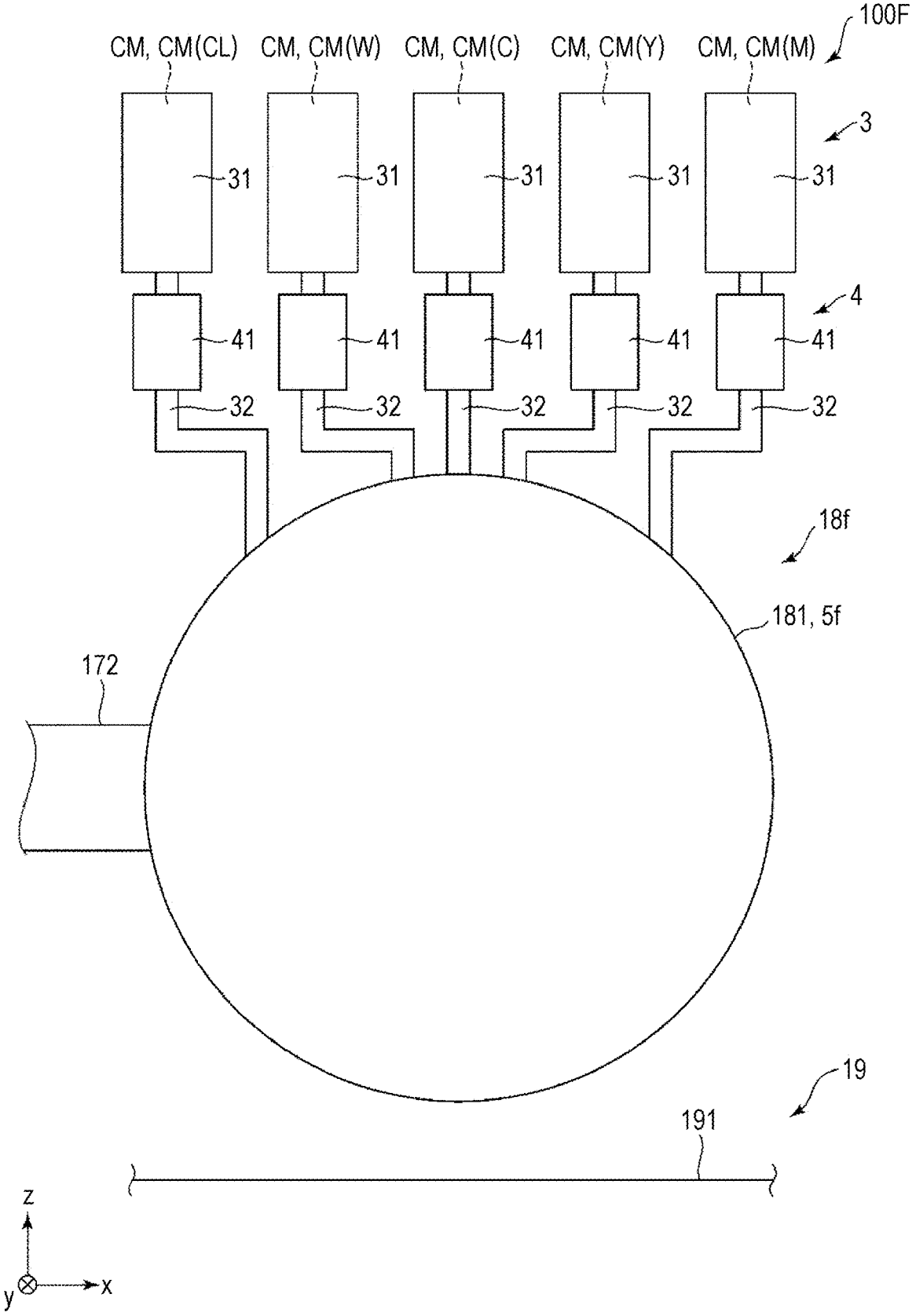
FIG. 20 is a schematic side view illustrating a dispersion unit and a periphery thereof included in a sheet manufacturing apparatus of a seventh embodiment to which the fibrous raw material recycling apparatus is applied.

FIG. 20 is a schematic side view illustrating the dispersion unit and a periphery thereof included in the sheet manufacturing apparatus (seventh embodiment) to which the fibrous raw material recycling apparatus is applied.

Hereinafter, the seventh embodiment of the sheet manufacturing apparatus, to which the fibrous raw material recycling apparatus is applied, will be described with reference to the drawings by focusing on differences from the embodiments described above, and the description of the same items is omitted.

A sheet manufacturing apparatus 100F of the embodiment is substantially the same as the fourth embodiment described above except that the color material supply unit has a different configuration.

As illustrated in FIG. 20, in the sheet manufacturing apparatus 100F of the embodiment, the color material supply unit 3 is configured to be capable of supplying the color material CM(W) which is the color material CM of white (achromatic color) and the color material CM(CL) which is the colorless transparent color material CM, in addition to the color material CM(C), the color material CM(Y), and the color material CM(M). For example, the color material CM(CL) is configured of colorless transparent resin particles. In addition, as necessary, a color material CM(BK) which is a color material CM of black may be formed.

The color material supply unit 3 includes the plurality of storage sections 31 that store individually the color material CM(W) and the color material CM(CL), respectively, and the flow channels 320 coupled to the corresponding storage sections 31. The switching unit 41 of the color material selector 4 is disposed on the flow channel 320.

It is possible to manufacture the sheet S having an increase in color variations by the color material supply unit 3 having such a configuration.

Eighth Embodiment

Figure 21:
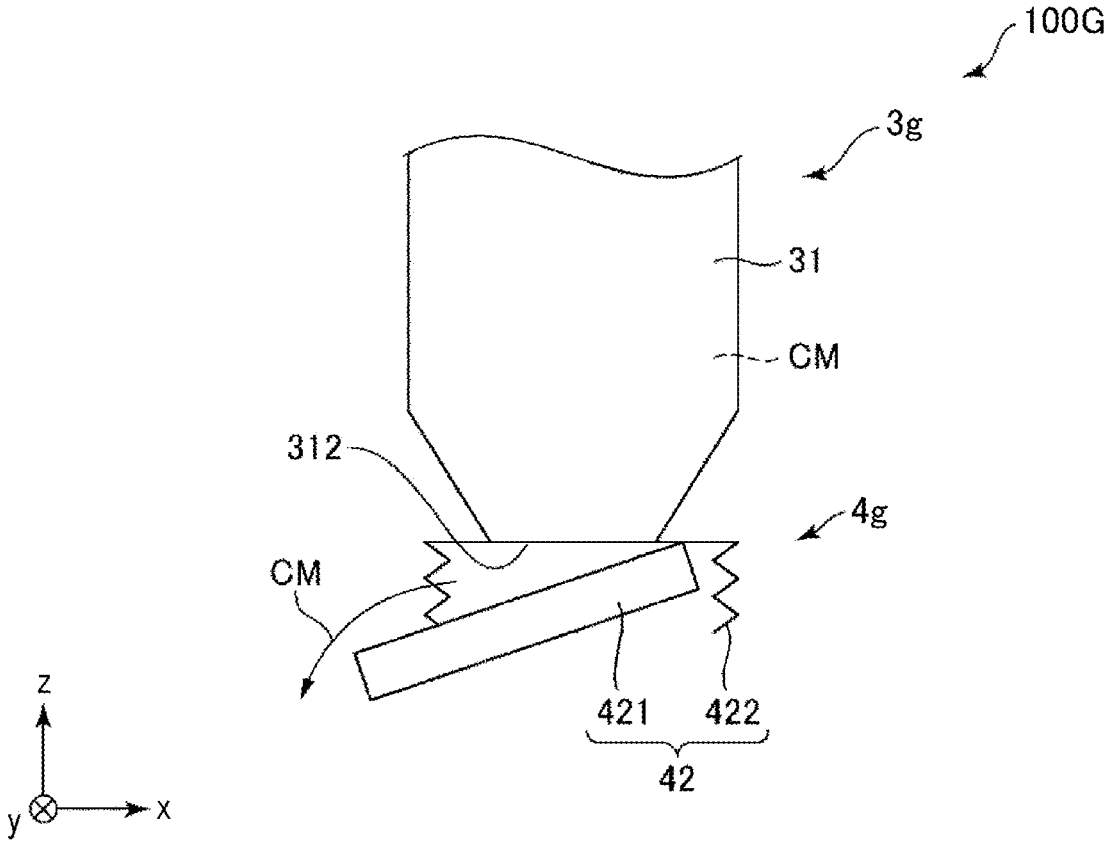
FIG. 21 is a vertical sectional view illustrating a configuration of a color material selector included in a sheet manufacturing apparatus of an eighth embodiment to which the fibrous raw material recycling apparatus is applied.

FIG. 21 is a vertical sectional view illustrating a configuration of the color material selector included in the sheet manufacturing apparatus (eighth embodiment) to which the fibrous raw material recycling apparatus is applied.

Hereinafter, the eighth embodiment of the sheet manufacturing apparatus, to which the fibrous raw material recycling apparatus is applied, will be described with reference to the drawings by focusing on differences from the embodiments described above, and the description of the same items is omitted.

A sheet manufacturing apparatus 100G of the embodiment is the same as the fourth embodiment described above except that the color material supply unit has a different configuration.

As illustrated in FIG. 21, in the embodiment, a switching unit 42 of a color material selector 4*g* includes a lid body 421, which is a vibration feeder and is pivotably supported to approach and be separated from a supply port 312 of the storage section 31, and a bias portion 422 that is configured of a spring which biases the lid body 421 in a direction in which the lid body approaches the supply port 312.

In a case where the lid body 421 comes into an opened state against a bias force of the bias portion 422, the color material CM is supplied via the supply port 312. In addition, in a case where the lid body 421 comes into a closed state by the bias force of the bias portion 422, supply of the color material CM is stopped. It is possible to easily switch between a color material supply state and a supply stop state by the switching unit 42 having such a configuration.

Ninth Embodiment

Figure 22:
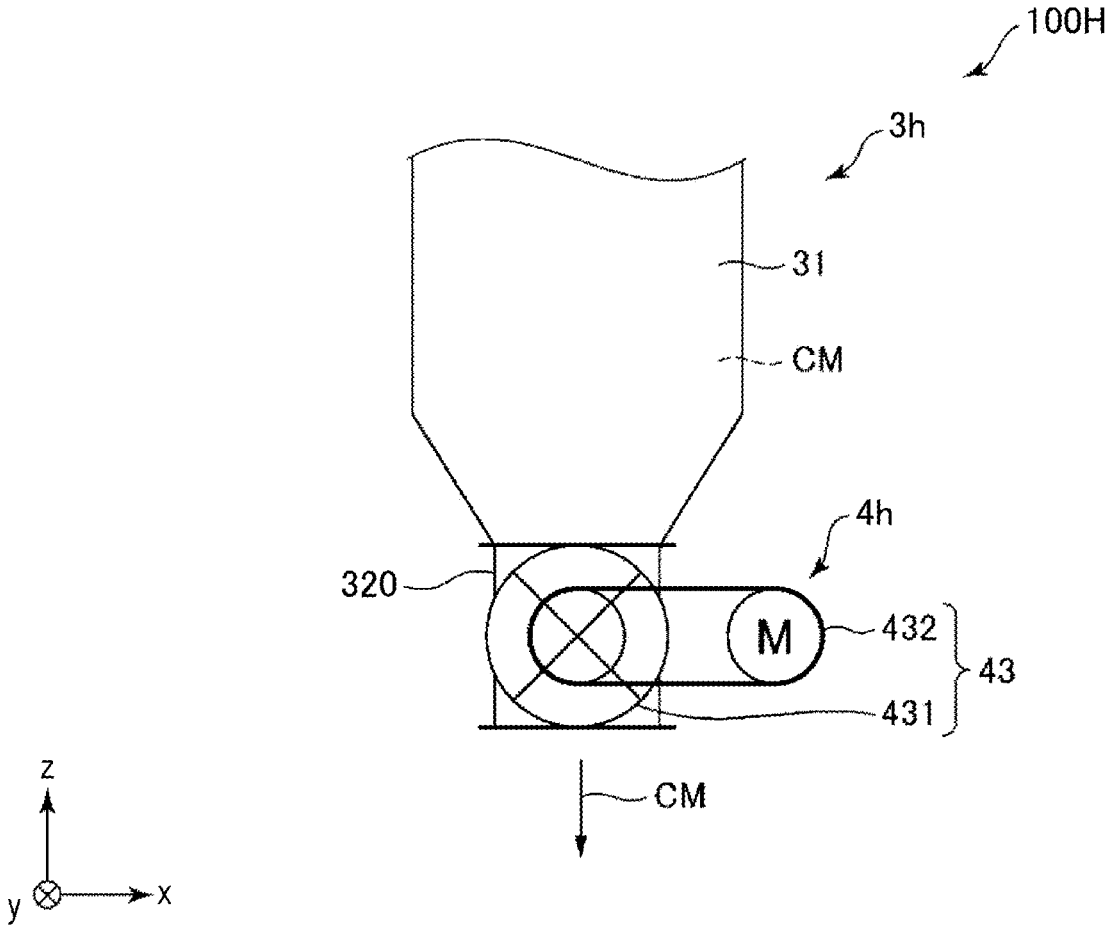
FIG. 22 is a vertical sectional view illustrating a configuration of a color material selector included in a sheet manufacturing apparatus of a ninth embodiment to which the fibrous raw material recycling apparatus is applied.

FIG. 22 is a vertical sectional view illustrating a configuration of the color material selector included in the sheet manufacturing apparatus (ninth embodiment) to which the fibrous raw material recycling apparatus is applied.

Hereinafter, the ninth embodiment of the sheet manufacturing apparatus, to which the fibrous raw material recycling apparatus is applied, will be described with reference to the drawings by focusing on differences from the embodiments described above, and the description of the same items is omitted.

A sheet manufacturing apparatus 100H of the embodiment is the same as the fourth embodiment described above except that the color material supply unit has a different configuration.

As illustrated in FIG. 22, in the embodiment, a switching unit 43 of a color material selector 4*h* includes a vane 431, which is a rotary feeder and is rotatably supported in the flow channel 320, and a drive unit 432 that is configured of a motor which rotatably drives the vane 431.

The vane 431 rotates, and thereby the color material CM is extracted from the storage section 31 and is extruded downstream as it is such that the color material supply state starts. Consequently, the color material CM can pass through the flow channel 320 so as to reach the drum section 181. In addition, the rotation of the vane 431 is stopped, and thereby extrusion of the color material CM is also stopped such that the supply stop state starts. It is possible to easily switch between the color material supply state and the supply stop state by the switching unit 43 having such a configuration.

Tenth Embodiment

Figure 23:
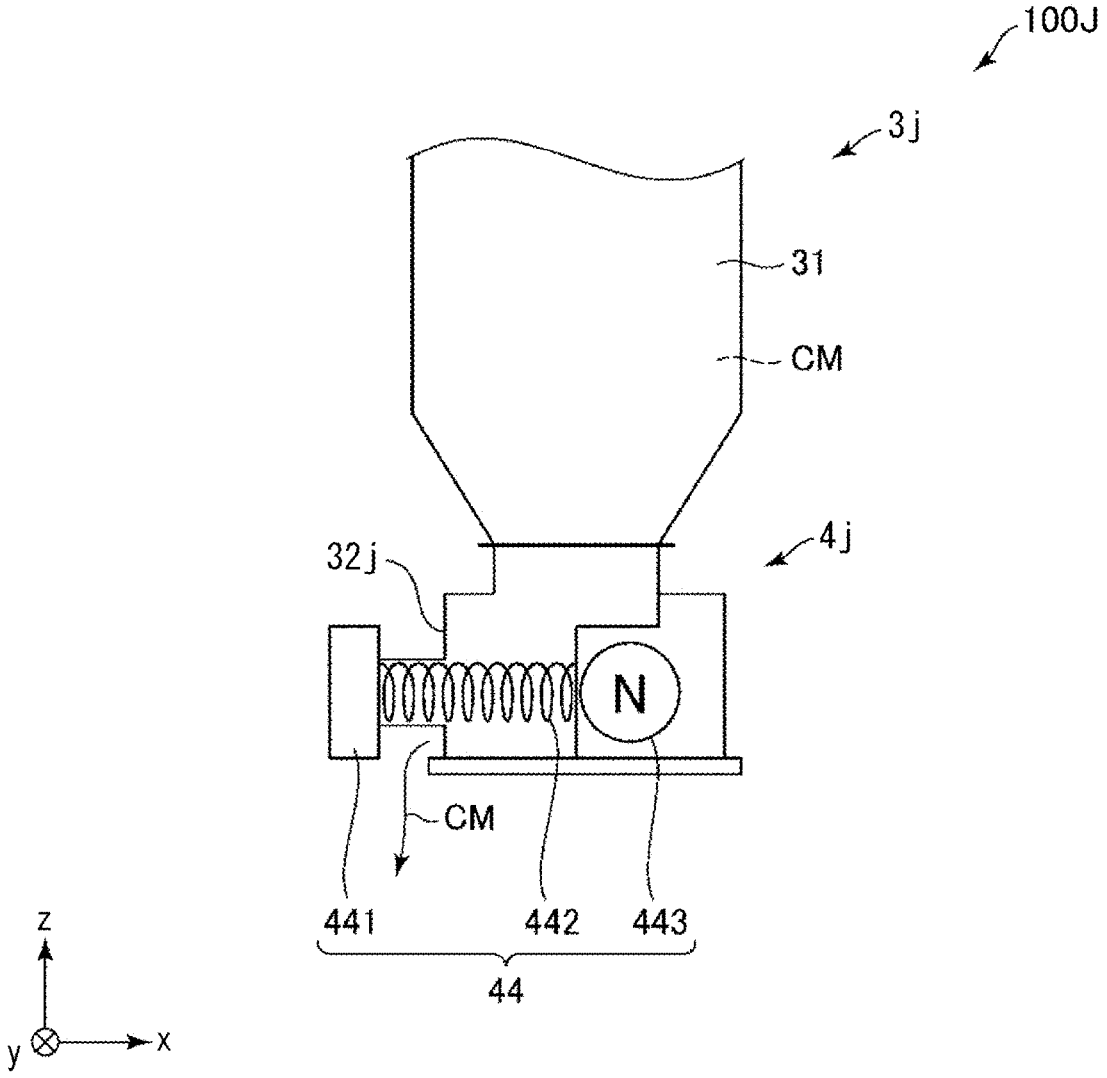
FIG. 23 is a vertical sectional view illustrating a configuration of a color material selector included in a sheet manufacturing apparatus of a tenth embodiment to which the fibrous raw material recycling apparatus is applied.

FIG. 23 is a vertical sectional view illustrating a configuration of the color material selector included in the sheet manufacturing apparatus (tenth embodiment) to which the fibrous raw material recycling apparatus is applied.

Hereinafter, the tenth embodiment of the sheet manufacturing apparatus, to which the fibrous raw material recycling apparatus is applied, will be described with reference to the drawings by focusing on differences from the embodiments described above, and the description of the same items is omitted.

A sheet manufacturing apparatus 100J of the embodiment is the same as the fourth embodiment described above except that the color material supply unit has a different configuration.

As illustrated in FIG. 23, in the embodiment, a switching unit 44 of a color material selector 4*j* includes a lid body 441, which is a CS feeder (straight feeder), is supported to openable/closable a portion in a flow channel 32*j*, and has magnetism, and a bias portion 442 that is configured of a spring which biases the lid body 441 in a direction of a closed state, for example, and an electromagnet 443.

In a case where a repulsive force acts on the lid body 441 by the electromagnet 443 such that the lid body 441 comes into an opened state against a bias force of the bias portion 442, the color material CM is supplied. In addition, in a case where the repulsive force disappears such that the lid body 441 comes into a closed state by the bias force of the bias portion 442, supply of the color material CM is stopped. It is possible to easily switch between the color material supply state and the supply stop state by the switching unit 44 having such a configuration.

As described above, the embodiments of the web forming device and the sheet manufacturing apparatus of the present disclosure are described. However, the present disclosure is not limited thereto, and the units that configure the web forming device and the sheet manufacturing apparatus can be replaced with any configuration that can exhibit the same function. In addition, any configurational component may be attached.

In addition, the web forming device and the sheet manufacturing apparatus of the present disclosure may be configured of a combination of two or more configurations (features) of the embodiments described above.

In addition, a product is not limited to the sheet S, and the sheet manufacturing apparatus may be configured to manufacture a hard sheet or a board-like or a web-like product configured of laminated sheets. In addition, a product is not limited to paper and may be a nonwoven fabric. In addition, the property of the sheet S is not particularly limited. The sheet may be paper that can be used as recording paper (for example, a so-called PPC sheet) for writing or printing or may be wall paper, wrapping paper, colored paper, paper for folding, a postcard, drawing paper, Kent paper, or the like. In addition, in a case where the sheet S is the nonwoven fabric, the sheet may be used as a textile board, tissue paper, kitchen paper, a cleaner, a filter, a liquid absorbent, a sound absorber, a cushioning material, a mat, or the like, in addition to the common nonwoven fabric.

What is claimed is:

1. A web forming device comprising:

a first material supplier including a first release port that releases a first material containing a first defibrated substance and a first organic binder into air;

a second material supplier including a second release port that releases a second material into the air, the second material containing a second defibrated substance and a second organic binder and being different from the first material;

a third material supplier including a third release port that releases a third material into the air, the third material containing a third defibrated substance and a third organic binder and being different from the second material; and a transporter that transports an accumulated substance of the first material and the second material, wherein the second release port is positioned downstream of the first release port in a transporting direction of the transporter, the third release port is positioned downstream of the second release port in the transporting direction, and the accumulated substance is a laminate of a layer of the first material and a layer of the second material.

2. The web forming device according to claim 1, wherein the transporter includes a mesh belt configured to transport in the transporting direction and a suction mechanism that suctions the layer of the first material and the layer of the second material which are accumulated on one surface of the mesh belt, from an opposite side of the mesh belt.

3. The web forming device according to claim 2, wherein the suction mechanism includes an upstream suction mechanism and a downstream suction mechanism provided downstream of the upstream suction mechanism relative to the transporting direction of the transporter.

4. The web forming device according to claim 1, wherein the first material supplier includes:

a first drum including a hole through which the first material passes; and a first housing that houses the first drum and includes the first release port, and the second material supplier includes:

a second drum including a hole through which the second material passes; and a second housing that houses the second drum and includes the second release port.

5. The web forming device according to claim 1, further comprising:

at least one of a first preselected material supplier that supplies a first preselected material to the first material supplier and a second preselected material supplier that supplies a second preselected material to the second material supplier.

6. The web forming device according to claim 5, further comprising:

both the first preselected material supplier and the second preselected material supplier, and the first preselected material and the second preselected material have different colors than each other.

7. The web forming device according to claim 1, further comprising:

a supply-amount adjuster that adjusts at least one of a supply amount of the first material and a supply amount of the second material.

8. The web forming device according to claim 1, further comprising:

a first defibrator that defibrates paper to generate the first defibrated substance; and a second defibrator that defibrates paper to generate the second defibrated substance.

9. A sheet manufacturing apparatus comprising:

the web forming device according to claim 1; and a former that heats and pressurizes the laminate to form the laminate into a sheet.

* * * * *